US010590724B2

(12) United States Patent
Hora et al.

(10) Patent No.: US 10,590,724 B2
(45) Date of Patent: Mar. 17, 2020

(54) MILL WITH ADJUSTABLE GAUGE DIAMETER

(71) Applicant: Wellbore Integrity Solutions LLC, Houston, TX (US)

(72) Inventors: Kenneth Daniel Hora, Houston, TX (US); Kenneth M. Nevlud, Tomball, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 666 days.

(21) Appl. No.: 14/521,952

(22) Filed: Oct. 23, 2014

(65) Prior Publication Data

US 2015/0114665 A1 Apr. 30, 2015

Related U.S. Application Data

(60) Provisional application No. 61/896,297, filed on Oct. 28, 2013.

(51) Int. Cl.
*E21B 29/00* (2006.01)

(52) U.S. Cl.
CPC ..... *E21B 29/005* (2013.01)

(58) Field of Classification Search
CPC ..... E21B 29/005; E21B 10/32; E21B 10/322; E21B 29/002
See application file for complete search history.

(56) References Cited

U.S. PATENT DOCUMENTS 1,553,852 A * 9/1925 Dion ..... B23D 77/042 408/167
2,908,330 A * 10/1959 Fredd ..... E21B 43/10 166/125
4,570,707 A * 2/1986 Setterberg, Jr. ..... E21B 23/02 166/214
4,842,082 A * 6/1989 Springer ..... E21B 10/32 166/173

(Continued)

FOREIGN PATENT DOCUMENTS

WO WO 02075104 A1 * 9/2002 ..... E21B 21/103

OTHER PUBLICATIONS

International Search Report and Written Opinion for International Patent Application No. PCT/US2014/062328, dated Feb. 10, 2015, Korean Intellectual Property Office, Daejeon Metropolitan City, Republic of Korea, 10 pages.

(Continued)

*Primary Examiner* — Cathleen R Hutchins
*Assistant Examiner* — Ronald R Runyan
(74) *Attorney, Agent, or Firm* — Hubbard Johnston, PLLC

(57) ABSTRACT

Milling tools, systems, and assemblies may have an adjustable gauge diameter. An example mill may include a body with tracks thereon. The tracks may slope in an axial direction and may be configured to couple to multiple blades. A locking collar may be positioned on the body and may be movable between multiple locking positions. Each locking position may be axially offset from another. At each locking position, the blades may be located at a different axial position on the body. Where the tracks slope, each different axial positions of the blades may also correspond to a different radial position for the blades. A gauge diameter of the blades may be based on the locking positions of the locking collar.

7 Claims, 18 Drawing Sheets

(56) References Cited

U.S. PATENT DOCUMENTS

| | | | | |
|---|---|---|---|---|
| 5,010,967 | A | 4/1991 | Desai | |
| 5,318,138 | A * | 6/1994 | Dewey | E21B 23/04 175/74 |
| 5,361,859 | A * | 11/1994 | Tibbitts | E21B 10/20 175/286 |
| 5,368,114 | A * | 11/1994 | Tandberg | E21B 10/322 175/267 |
| 6,152,657 | A | 11/2000 | Packer et al. | |
| 6,170,576 | B1 | 1/2001 | Brunnert et al. | |
| 6,568,492 | B2 | 5/2003 | Thigpen et al. | |
| 7,108,064 | B2 | 9/2006 | Hart et al. | |
| 7,325,631 | B2 | 2/2008 | Roberts et al. | |
| 7,410,015 | B2 | 8/2008 | Denoix | |
| 7,506,703 | B2 * | 3/2009 | Campbell | E21B 10/322 175/265 |
| 7,703,553 | B2 * | 4/2010 | Eddison | E21B 10/32 175/269 |
| 7,721,823 | B2 | 5/2010 | Radford | |
| 7,753,139 | B2 | 7/2010 | Dewey et al. | |
| 8,127,851 | B2 | 3/2012 | Misselbrook | |
| 8,905,126 | B2 | 12/2014 | Krieg et al. | |
| 9,051,792 | B2 * | 6/2015 | Herberg | E21B 10/32 |
| 2007/0007000 | A1 * | 1/2007 | Dewey | E21B 10/62 166/55.7 |
| 2007/0089912 | A1 * | 4/2007 | Eddison | E21B 10/32 175/269 |
| 2009/0032308 | A1 | 2/2009 | Eddison | |
| 2010/0065264 | A1 * | 3/2010 | Nackerud | E21B 10/322 166/55.7 |
| 2010/0077677 | A1 * | 4/2010 | Floyd | E02D 29/12 52/169.14 |
| 2010/0096191 | A1 | 4/2010 | Lassoie et al. | |
| 2010/0224414 | A1 | 9/2010 | Radford et al. | |
| 2012/0186823 | A1 | 7/2012 | Xu | |
| 2013/0153300 | A1 | 6/2013 | Radford et al. | |
| 2014/0262523 | A1 * | 9/2014 | Davis | E21B 10/322 175/57 |

OTHER PUBLICATIONS

Brown, Martin D. and Gledhill, Andrew D., "Expandable Drill Bit provides new method of drilling increased diameter hole," SPE/IADC 79793, SPE/IADC Drilling Conference, Feb. 19-21, 2003, Amsterdam, The Netherlands, 6 pages.

International Preliminary Report on Patentability issued in International Patent Application No. PCT/US2014/062328 dated May 3, 2016, 6 pages.

* cited by examiner

MILL WITH ADJUSTABLE GAUGE DIAMETER

CROSS-REFERENCE TO RELATED APPLICATIONS

This application claims the benefit of, and priority to, U.S. Patent Application Ser. No. 61/896,297, filed Oct. 28, 2013 and titled "MILLING TOOL WITH MOVABLE BLADES", which application is expressly incorporated herein by this reference in its entirety.

BACKGROUND

Milling tools may be used in oilfield operations to perform a variety of tasks. Particularly, a milling tool may include cutting structures used primarily to shear, grind, or otherwise cut material (e.g., metal, plastic, composite, etc.) at various downhole locations. For example, a milling tool may be used in the removal of various downhole obstructions. In particular, the milling tool may be used to clean out obstructions that may exist within a string of casing or tubing, such as plugs (e.g., bridge plugs, frac plugs, etc.), objects accidentally dropped downhole from the surface (e.g., hand tools, wrenches, etc.), components of drilling apparatuses that have broken off downhole (e.g., drill bit teeth, nozzles, etc.), or accumulated cement, scale, or sediment within the casing or tubing. In addition, a milling tool may be used to cut windows in a cased portion of a wellbore to allow sidetracking operations or to mill out a section of casing for a well abandonment or slot recovery operation.

SUMMARY

Described herein are example embodiments of downhole tools, mills, milling tools, and adjustable tools. In some embodiments, for instance, a downhole tool may include a body that may be coupled to a drill string. Tracks may extend axially along at least a portion of the length of the body. A locking collar may be coupled to the body, and may move axially along the body between multiple locking positions. Blades may be coupled to the tracks, and a gauge diameter of the blades may vary based on the locking positions of the locking collar.

In another embodiment, a mill includes a body with sloped tracks that extend axially along the body. A locking collar may be coupled to the body and may move axially along the body between different locking positions. Blades may be coupled to the sloped tracks. The gauge diameter of the blades may be adjusted based on the axial position of the blades relative to the sloped tracks. The axial position of the blades may correspond to a locking position of the locking collar. A locking head may also be coupled to the body to fix the axial position of the blades between the locking collar and the locking head.

In yet another embodiment, a method may include coupling a locking collar to a body of a mill. Blades may be coupled to sloped tracks on the body, and downhole of the locking collar. The locking collar may be locked at a locking position on the body of the mill, and the blades may be locked to the body of the mill such that the locking collar, at least in part, restricts axial and/or radial movement of the blades.

This summary is provided to introduce various concepts in a simplified form, and which are further described below. The summary is not intended to indicate that any feature or component is key or essential, and should not be used to limit the scope of the present disclosure or the claimed subject matter.

BRIEF DESCRIPTION OF THE DRAWINGS

In order to describe various features and concepts of the present disclosure, a more particular description of certain subject matter will be rendered by reference to specific embodiments which are illustrated in the appended drawings. These drawings depict some example embodiments and are not to be considered to be limiting in scope of the present disclosure. While certain drawings are drawn to scale for some embodiments, the drawings are not drawn to scale for each embodiment contemplated hereby. Recognizing the foregoing, various embodiments will be described and explained with additional specificity and detail through the use of the accompanying drawings in which:

FIG. 2-1 is a perspective view of a milling tool having adjustable blades for a milling operation, according to some embodiments of the present disclosure;

FIG. 2-2 is an exploded, assembly view of the milling tool of FIG. 2-1, according to some embodiments of the present disclosure;

FIG. 4-1 is a side view of the milling tool of FIGS. 2-1 and 2-2, the blades of the milling tool being in an expanded radial position, according to some embodiments of the present disclosure;

FIG. 4-2 is a cross-sectional view of the milling tool of FIG. 4-1, according to some embodiments of the present disclosure;

FIG. 5-1 is a side view of the milling tool of FIGS. 2-1 and 2-2, the blades of the milling tool being in a retracted radial position relative to the embodiment shown in FIGS. 4-1 and 4-2, according to some embodiments of the present disclosure;

FIG. 5-2 is a cross-sectional view of the milling tool of FIG. 5-1, according to some embodiments of the present disclosure;

FIG. 5-3 is a cross-sectional side view of the milling tool of FIGS. 5-1 and 5-2, according to some embodiments of the present disclosure;

FIG. 6-1 is a perspective view of a blade for use with some milling tools of the present disclosure;

FIG. 6-2 is a top view of the blade of FIG. 6-1, according to some embodiments of the present disclosure;

FIGS. 7-1 to 7-3 are perspective views of the milling tool of FIGS. 2-1 and 2-2 during various stages of assembly, according to some embodiments of the present disclosure;

FIG. 11-1 is a side view of the milling tool of FIG. 10, with blades in an expanded radial position, according to some embodiments of the present disclosure; and FIG. 11-2 is a side view of the milling tool of FIG. 10, with the blades in a minimum radial position, according to some embodiments of the present disclosure.

DETAILED DESCRIPTION

In accordance with some aspects of the present disclosure, embodiments herein relate to milling tools. According to other aspects of the present disclosure, embodiments herein relate to downhole tools. In still other aspects of the present disclosure, embodiments herein relate to expandable tools. More particularly, some embodiments disclosed herein may relate to downhole and/or milling tools and systems, and bottomhole assemblies that include an expandable tool. An example expandable tool may be a mill for use in a scale removal, sidetracking, junk milling, casing milling, remedial, or other downhole operations. In still other aspects, embodiments of the present disclosure may relate to a mill having expandable blades that allow mill blades to selectively expand for use with different sizes of casings or wellbores.

Figure 1:
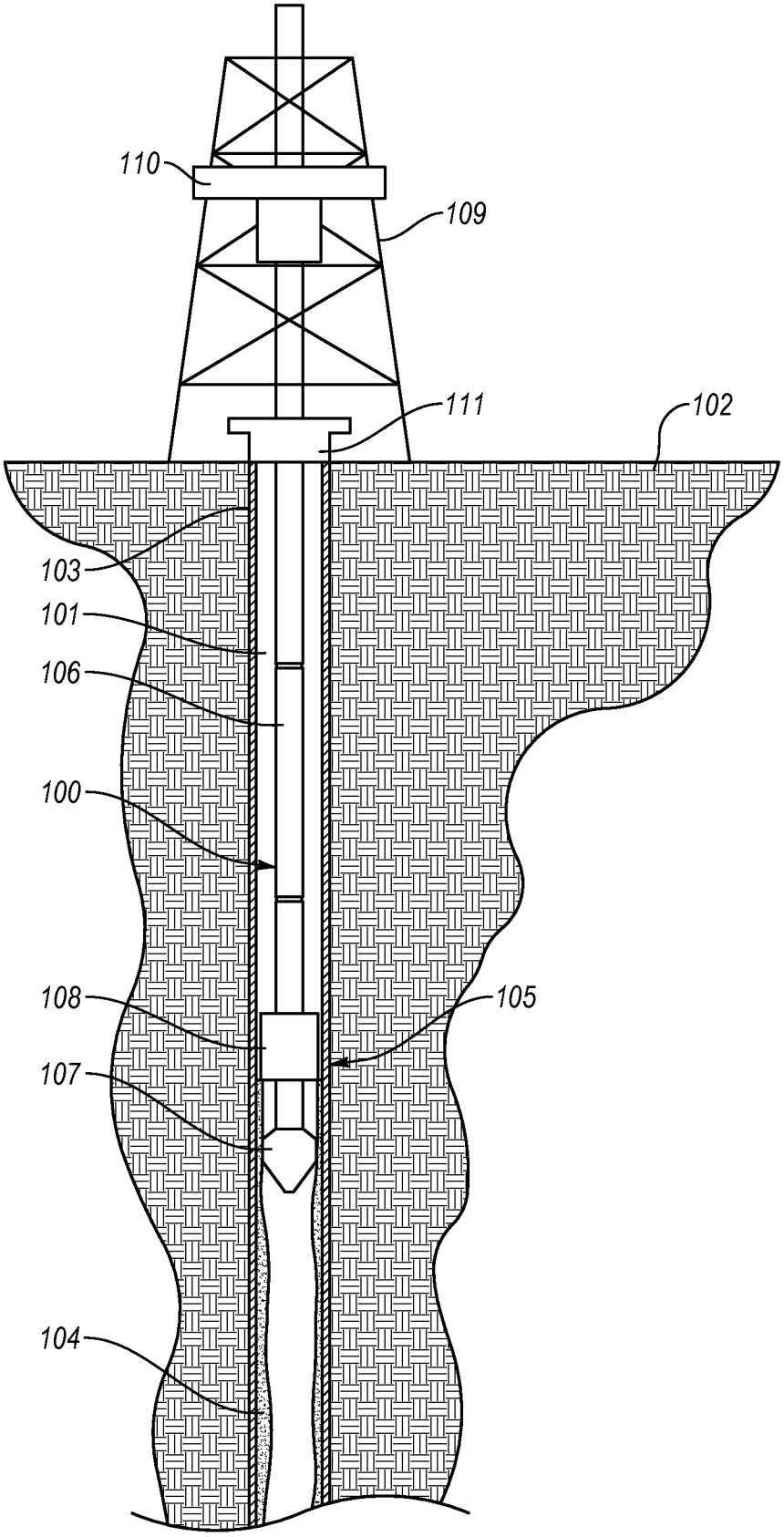
FIG. 1 is a schematic view of a downhole environment for using a milling tool, in accordance with some embodiments of the present disclosure.

Referring now to FIG. 1, a schematic diagram is provided of an example environment that may utilize systems, assemblies, devices, and methods in accordance with embodiments of the present disclosure. More particularly, FIG. 1 shows an example downhole tool 100 within a wellbore 101 formed in a subterranean formation 102. In this particular embodiment, the wellbore 101 includes casing 103 installed therein. The casing 103 may extend along a full length of the wellbore 101; however, in other embodiments, at least a portion of the wellbore 101 may be an openhole or uncased portion of the wellbore. The casing 103 within the wellbore 101 may include various types of casing, including surface casing, intermediate casing, conductor casing, production casing, production liner, and the like. In some embodiments, as the depth of the wellbore 101 increases, the diameter of the casing 103 may decrease.

In at least some embodiments, the casing 103 may provide structural integrity to the wellbore 101, isolate the wellbore 101 against fluids within the subterranean formation 102, or perform other aspects or functions. In some applications, after the casing 103 is cemented or otherwise installed within the wellbore 101, a portion of the casing 103 may be removed or perforated to facilitate a downhole operation.

Over time, debris 104 may build up within the wellbore 101. The debris 104 may be loose debris; however, in some embodiments the debris 104 may include cement or so-called "scale." Scale may occur as deposits build-up on the surface of the casing 103 in the wellbore 101. The casing 103 may have a relatively smooth or constant diameter interior surface, which may facilitate the flow of fluid and the movement of tools within the wellbore 101. Deposits of scale on the interior surface of the casing 103 may, however, reduce the available diameter, and may be uneven, thereby restricting or obstructing fluid or tool movement within the wellbore 101. In some cases, the scale or other debris 104 may cover perforations or openings within the casing 103, which may decrease the utility of such openings.

In at least some embodiments, the scale or other debris 104 may be removed in whole or part by using the downhole tool 100. For instance, the downhole tool 100 may include a mill 105 coupled to a drill string 106. When the downhole tool 100 includes the mill 105, the downhole tool 100 may also be considered a milling assembly or milling tool. The drill string 106 may include sections of drill pipe, transition drill pipe, drill collars, other drive mechanisms, or other delivery devices that allow the mill 105 to be tripped into the wellbore 101, weight-on-bit to be applied to the mill 105, to mill within the wellbore 101, to remove a portion of the debris 104, or any combination of the foregoing.

The downhole tool 100 may include multiple mills or multiple components. In this particular, non-limiting embodiment, for instance, the mill 105 may include a lead mill 107 and a follow mill 108. The lead mill 107 may be a taper mill, window mill, or the like, and may be located at a downhole end portion of the downhole tool 100. The follow mill 108 may be uphole relative to the lead mill 107. In some embodiments, the follow mill 108 may have a gauge diameter that is equal to, larger than, or smaller than a gauge diameter of the lead mill 107. The lead mill 107 may rotate and move within the wellbore 101, and may be configured to remove some deposits of scale or other debris 104. The lead mill 107 may be used to direct and/or center the mill 105 within the wellbore 105. The follow mill 108 may rotate and move within the wellbore 101, and may remove additional debris 104 left behind by the lead mill 107. Where the follow mill 108 has a larger gauge diameter than the lead mill 107, the follow mill 108 may remove scale or other debris 104 that is nearer the interior surface of the casing 103. In some embodiments, the lead mill 107 and/or the follow mill 108 may have a diameter that is about equal to the nominal or drift diameter of the interior of the casing 103. In other embodiments, the lead mill 107 and/or the follow mill 108 may have a diameter that is less than the nominal or drift diameter of the interior of the casing 103. In some embodiments, the downhole tool 100 may be used to remove scale or other debris in a tubular element other than, or in addition to, the casing 103.

In the particular embodiment illustrated in FIG. 1, the downhole tool 100 may be provided to facilitate a milling operation. The mill 105 may be part of a bottomhole assembly ("BHA") connected to the drill string 106. In FIG. 1, the drill string 106 is illustrated as extending from the surface and having the bottomhole assembly or downhole tool 100 at a distal end portion thereof. The drill string 106 may include one or more tubular members. The tubular members of the drill string 106 may themselves have any number of configurations. As an example, the drill string 106 may include segmented/jointed drill pipe or wired drill pipe. Such drill pipe may include rotary shouldered or other threaded connections on opposing end portions to allow segments of drill pipe to be coupled together to increase the length of the drill string 106 as the downhole tool 100 and the mill 105 (along with other components of the BHA) are tripped further into the wellbore 101, or disconnected to shorten the length of the drill string 106 as the mill 105 is tripped out of the wellbore 101. The drill string 106 may also include continuous components such as coiled tubing. Couplings, drill collars, transition drill pipe, stabilizers, and other drill string, downhole tool, and bottomhole assembly components known in the art, or combinations of the foregoing, may also be used. The BHA and the downhole tool 100 may also include additional or other components, including jars, vibrational conveyance tools, stabilizers, disconnect subs, measurement-while-drilling tools, logging-while-drilling tools, communication subs, or the like. In some embodiments, the lead mill 107 may be removed. In other embodiments, the lead mill 107 may be a drill bit.

To use the mill 105 for a downhole operation, uphole or downhole rotational power may be provided to rotate the mill 105. A drilling rig 109, for instance, may be used to convey the drill string 106, downhole tool 100, and mill 105 into the wellbore 101. In an example embodiment, the drilling rig 109 may include a derrick and hoisting system 110, a rotating system, a mud circulation system, or other components. The derrick and hoisting system 110 may suspend the downhole tool 100, and the drill string 106 may pass through a wellhead 111 and into the wellbore 101. In some embodiments, the drilling rig 109 or derrick and hoisting system 110 may include a draw works, a fast line, a crown block, drilling line, a traveling block and hook, a swivel, a deadline, other components, or some combination of the foregoing. An example rotating system may be used, for instance, to rotate the drill string 106 and thereby also rotate the mill 105 or other components of the downhole tool 100. The rotating system may include a top drive, kelly, rotary table, or other components that can rotate the drill string 106 at or above the surface. In such an embodiment, the drill string 106 may be a drive mechanism for use in driving, or rotating, the mill 105.

In other embodiments, the mill 105 may be rotated by using a downhole component. For instance, the downhole tool 100 and the drill string 106 may include a downhole motor. The downhole motor may operate as a drive mechanism and may include any motor that may be placed downhole, and expressly may include, but is not limited to, a mud motor, turbine motor, other motors or pumps, any component thereof, or any combination of the foregoing. A mud motor may include fluid-powered motors such as positive displacement motors ("PDM"), progressive cavity pumps, Moineau pumps, other type of motors, or some combinations of the foregoing. Such motors or pumps may include a helical or lobed rotor that is rotated by flowing drilling fluid. As discussed herein, the drill string 106 may include coiled tubing, slim drill pipe, segmented drill pipe, or other structures that include an interior channel within a tubular structure so as to allow drilling fluid to pass from the surface to the downhole motor. In the mud motor, the flowing drilling fluid may rotate the lobed rotor relative to a stator. The rotor may be coupled to a drive shaft which can directly or indirectly be used to rotate the mill 105. In the same or other embodiments, the motor may include turbines. A turbine motor may be fluid-powered and may include one or more turbines or turbine stages that include a set of stator vanes that direct drilling fluid against a set of rotor blades. When the drilling fluid contacts the rotor blades, the rotor may rotate relative to the stator and a housing of the turbine motor. The rotor blades may be coupled to a drive shaft (e.g., through compression, mechanical fasteners, etc.), which may also rotate and cause the mill 105 to rotate. When coiled tubing or other similar components are used for the drill string 106, the drilling rig 109 may also included injector equipment, pumps, control equipment, and other components for a well intervention process.

Although the drilling rig 109 is shown in FIG. 1 as being on land, those of skill in the art will recognize that embodiments of the present disclosure are also equally applicable to offshore and marine environments. Additionally, while embodiments herein discuss milling operations within a cased wellbore, in other embodiments, aspects of the present disclosure may be used in a milling or drilling operation in an openhole wellbore, or an openhole section within a wellbore. Further still, milling or drilling systems may be used in accordance with some embodiments of the present disclosure above the surface rather than in a downhole environment. Further still, while FIG. 1 illustrates an embodiment in which a downhole tool 100 with a mill 105 is used to remove scale or other debris 104, the same or a similar tool may be used in other downhole operations. In a sidetracking operation, for instance, a whipstock (not shown) may be positioned within the wellbore 101. The lead mill 107 may be deflected by the whipstock into the casing 103 to form a window or opening therein. The follow mill 108 may then follow the lead mill 107 through the window, and may clean-up edges or, in some embodiments, enlarge the window. In some embodiments, the mill 105 may include expandable blades for use as stabilizer or milling blades. For instance, the follow mill 108 may have blades that selectively expand to different sizes for use in milling within the wellbore 101. In another embodiment, the follow mill 108 may be an expandable stabilizer with the blades being expandable to stabilize the downhole tool (including the lead mill 107) during a downhole milling or drilling operation.

Figures 1, 2:
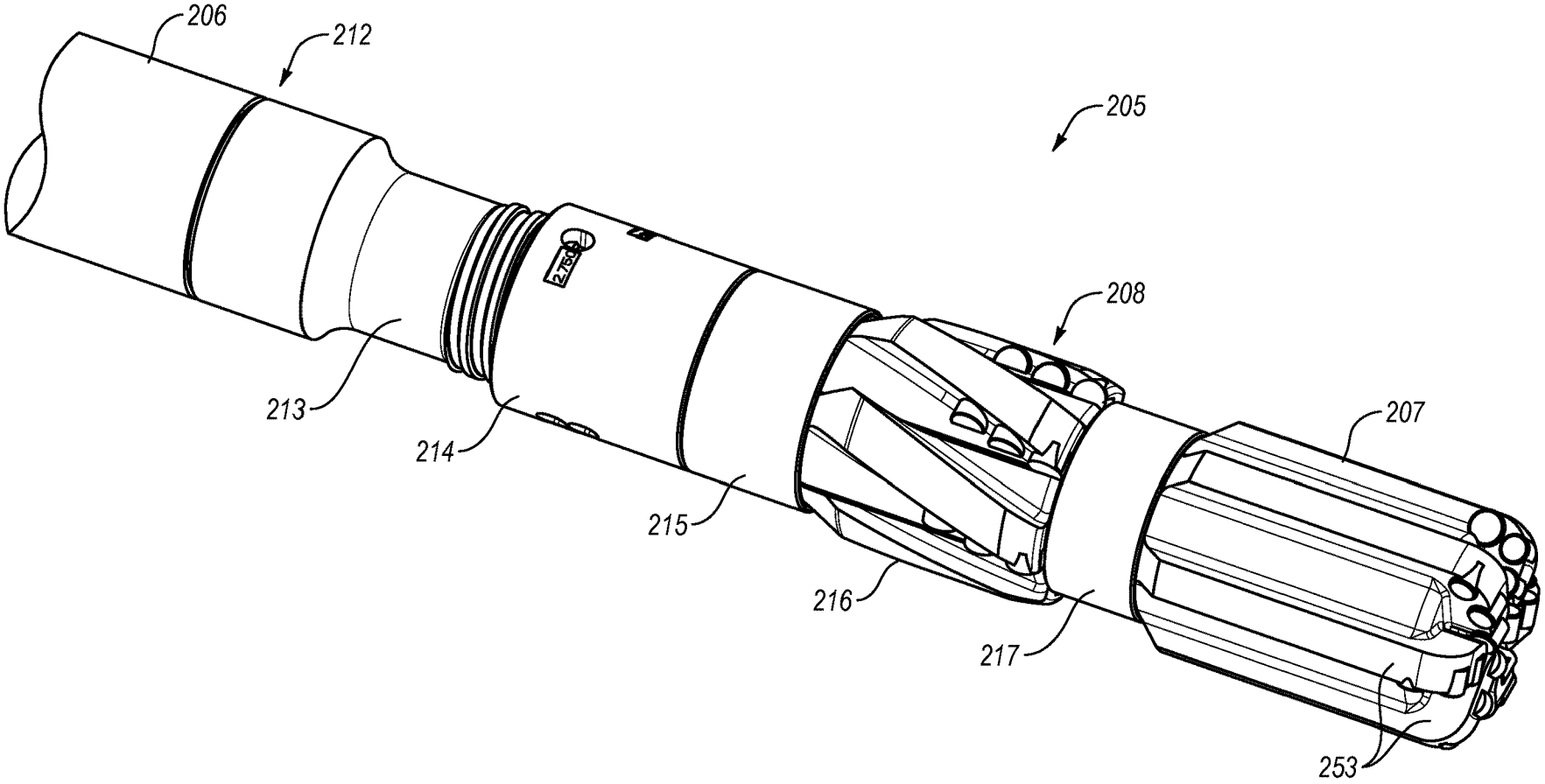
Figure 2:
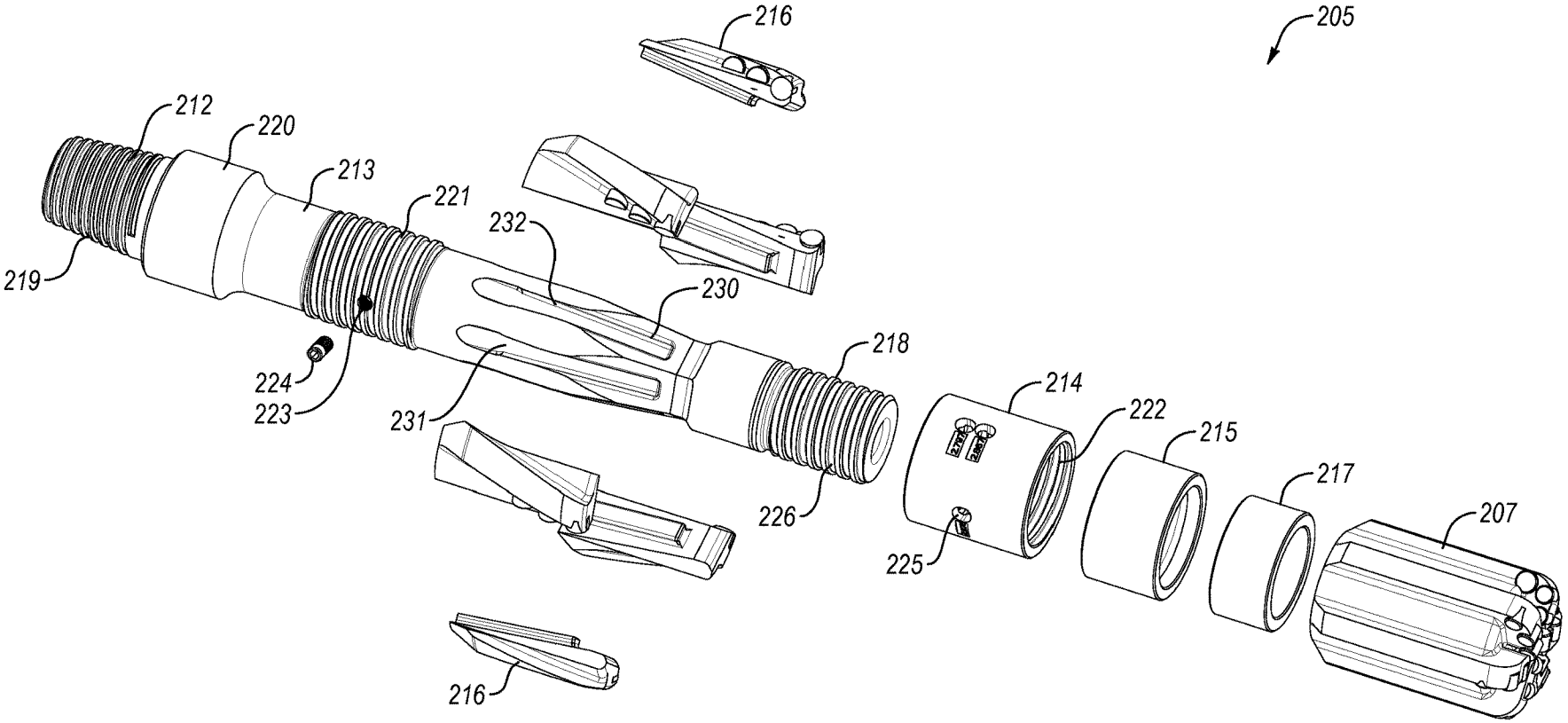

Referring now to FIG. 2-1, a perspective view of an example milling tool (i.e., mill 205) is illustrated in accordance with aspects of various embodiments described herein. An uphole (or proximal) end portion 212 of the mill 205 may be configured to couple to a drill string 206. In some embodiments, the mill 205 may include a body 213, a locking collar 214, a first spacer 215, a plurality of blades 216, a second spacer 217, a lead mill 207, some other or additional component, or some combination of the foregoing. The locking collar 214 may be positioned on or coupled to the body 213 uphole relative to first spacer 215, which may be uphole relative to the blades 216. The locking collar 214 and the first spacer 215 may be separate components; however, in some embodiments, the first spacer 215 may be integral with the locking collar 214. Further, the blades 216 may be positioned on or coupled to the body 213 uphole relative to the second spacer 217, which may be uphole relative to the lead mill 207. In some embodiments, the blades 216 may collectively act as a follow mill 208. The lead mill 207 may be movably coupled to a downhole (or distal) end portion 218 (see FIG. 2-2) of the body 213 (or other portion of the mill 205). In another embodiment, the mill 205 may not include some components, such as the first spacer 215 and/or the second spacer 217.

As further described herein, the locking collar 214 may be movably coupled to the body 213, such that the locking collar 214 may be positioned at any one of several locking positions on the body 213. The blades 216 may also be movably coupled to the body 213. In some embodiments, movement of the blades 216 may be constrained in one or more directions by the locking collar 214 and/or the body 213. Accordingly, the blades 216 may be positioned on the body 213 at one of several axial positions based on the locking position of the locking collar 214. In turn, due to a sloped or tapered outer diameter of the body 213, a radial position of the blades 216, and thus a gauge or outer diameter of the blades 216 and the follow mill 208, may vary based on their respective axial positions, as further described herein.

FIG. 2-2 is an exploded, assembly view of the mill 205 of FIG. 2-1, in accordance with aspects of various embodiments described herein. The body 213 may be composed of steel or any other metal, alloy, composite, polymer, organic material, or other material known to those skilled in the art, or to some combination of the foregoing. In some embodiments, the body 213 may be substantially cylindrical, or have multiple substantially cylindrical portions, may configured to rotate in conjunction with an attached drill string (e.g. drill string 106 of FIG. 1 and/or drill string 206 of FIG. 2-1), or may have a central bore extending fully or partially therethrough. In particular, the uphole end portion 212 of the body 213 may include first threads 219 formed on the body 213 and configured to couple to a threaded section (not shown) of a corresponding drill string. The body 213 may also include a shoulder 220, which may be located downhole from and optionally proximate to the first threads 219. The shoulder 220 may be formed by a change in an outer diameter of the body 213. For instance, the outer diameter of the body 213 at the shoulder 220 may be larger than an outer diameter of the body 213 along at least a portion of the threads 202. In some embodiments, the shoulder 220, or an upper portion thereof, may be configured to engage an end portion of a drill string coupled to the first threads 219.

The body 213 may also include collar threads, or second threads 221, which may be positioned downhole from the shoulder 220 in some embodiments. As described further herein, the locking collar 214 may include internal threads 222 configured to mate with and engage the second threads 221, such that the locking collar 214 may be threaded to one of one or more axial positions along the second threads 221 and the body 213. Optionally, the locking collar 214 may be locked at one or more of the axial positions. In some embodiments, the locking collar 214 may lock or be secured relative to the body 213 using an opening in the body 213, and a fastener configured to cooperate with the opening. For instance, the opening may include a threaded opening 223 and the fastener may include an indicator screw 224. In such an embodiment, and as described in further detail herein, the threaded opening 223 may threadably receive the indicator screw 224 which may be a set screw or other device. The threaded opening 223 may have internal threads that engage with the threads of the indicator screw 224. The locking collar 214 may also include one or more corresponding openings (e.g., indicator openings 225), and the indicator screw 224 may be secured within both the threaded opening 223 and the indicator opening 225 to rotationally and/or axially secure, or lock, the locking collar 214 to the body 213 at one or more locking positions. In some embodiments, the threaded opening 223 may be located within the second threads 221. Additionally, multiple threaded openings 201 may be provided, although in a further embodiment, the body 213 may include no more than one threaded opening 223.

Further, rather than a threaded opening 223, other embodiments contemplate other suitable structures, including pin openings, clamps, clasps, and the like. The locking collar 214 may also include one or more indicator openings 225, which may or may not be threaded. In still other embodiments, the indicator screw 224 and/or the threaded opening 223 may include or be replaced by any number of components. For instance, rather than being a threaded screw or other similar component, the fastener may include a pin, clasp, or the like. In some embodiments, the body 213 may include a spring loaded pin that may be fixed to the body 213 and biased in a radially outward direction. The biasing force may, however, be overcome to allow the locking collar 214 to rotate relative to the body 213. When the pin is then aligned with another indicator opening 225 of the locking collar 214, the biasing force may push the pin into the indicator opening 225 to lock the axial and/or rotational position of the locking collar 214.

A downhole end portion 218 of the body 213 may include third threads 226, in some embodiments. The third threads 226 may be lower threads configured to engage a lead mill 207. The lead mill 207 may include internal threads 227 (see FIG. 5-3) which may engage with the third threads 226, thereby coupling the lead mill 207 to the body 213.

In some embodiments, the body 213 may further include tracks 230, which may be used to couple the blades 216 to the body 213 and/or to guide movement of the blades 216 relative to the body 213. The tracks 230 may extend in an axial direction. In some embodiments, the tracks 230 may be linear. In other embodiments, the tracks 230 may be curved, arcuate, helical, have other configurations, or include a combination of the foregoing.

In some embodiments, and as described herein, a track 230 may engage with, or otherwise interact with, a blade 216. The tracks 230 may be axially positioned between the second and third threads 221, 226 and along an outer surface of the body 213. In some embodiments, the tracks 230 may be distributed about equidistantly around the outer diameter (i.e., at about equal angular offsets). In other embodiments, at least two tracks 230 may be unequally distributed around the outer diameter of the body 213. In some embodiments, there may be between 1 and 12 tracks 230. For instance, the number of tracks 230 may be within a range that includes lower and/or upper limits including any of 2, 3, 4, 5, 6, 8, 10, 12, or values therebetween. In other embodiments, there may be more than 12 tracks. In still other embodiments, the tracks 230 may be eliminated and replaced with other components for coupling the blades 216 to the body 213.

Figure 3:
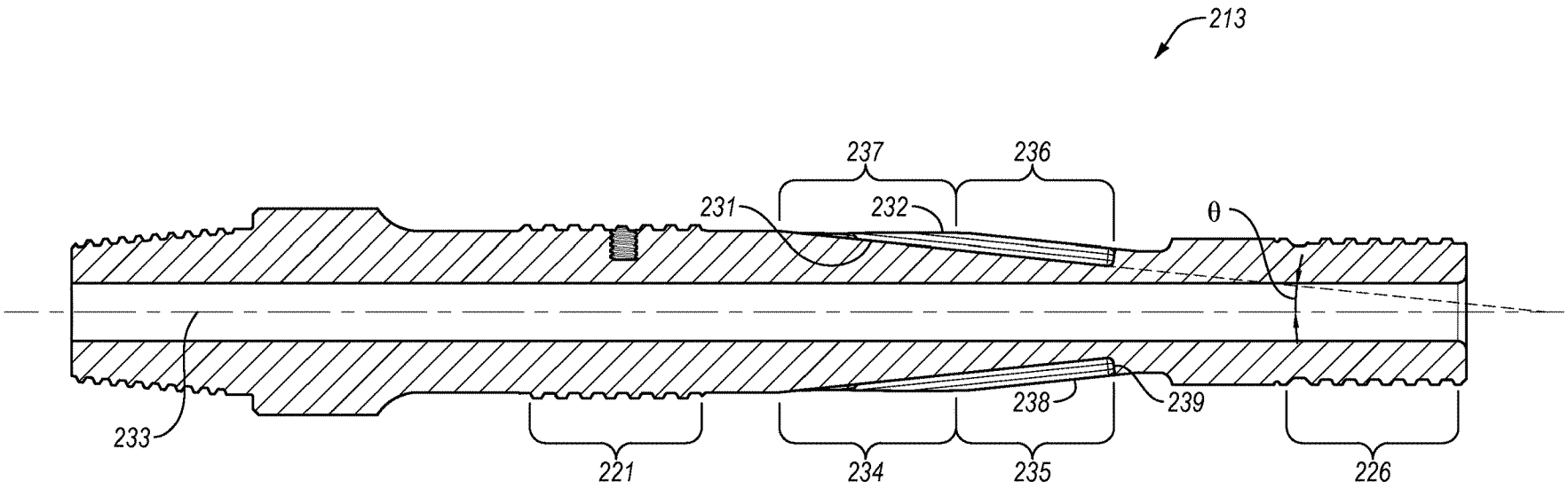
FIG. 3 is a cross-sectional side view of a body of the milling tool of FIGS. 2-1 and 2-2, according to some embodiments of the present disclosure.

Referring now to FIG. 3, which is a cross-sectional side view of the body 213 of FIGS. 2-1 and 2-2, each track 230 may include a ramp 231 and one or more rails 232. In some embodiments, the ramp 231 may extend along the outer diameter of the body 213 for the entire length of a corresponding track 230. In some embodiments, the ramp 231 may be set at an angle (e.g., an increasing or decreasing slope or taper), relative to a longitudinal axis 233 of the body 213. Accordingly, the ramp 231 may be a portion of the body 213 having an outer diameter which gradually increases or decreases in size in a downhole (or distally-directed) direction (e.g., from second threads 221 toward third threads 226). Accordingly, the tracks 230 may also be referred to as sloped tracks in some embodiments. In one example, the slope θ of one or more of the ramps 231 relative to the longitudinal axis 233 may be between 0.25° and 30°. More particularly, the slope θ of the ramps 231 may be within a range including lower and/or upper limits that include any of 0.25°, 0.5°, 1°, 2°, 4°, 5°, 6°, 8°, 10°, 15°, 20°, 30°, or values therebetween. Accordingly, in some embodiments, the slope θ of a ramp 231 may be from 2° to 10°, from 4° to 8°, from 5° to 7°, or from 5.5° to 6.5°. For instance, the slope θ of a ramp 231 may be 6°. One or more of the ramps 231 may have a constant or variable slope θ. Where a ramp 231 has a variable slope θ or taper, the slope θ of the ramp 231 may refer to a slope at a particular section or an average slope of multiple sections of the ramp 231.

As shown in FIG. 3, some embodiments include a ramp 231 of the track 230 that may slope inward at a constant or variable slope relative to the longitudinal axis 233 in a downhole direction. Accordingly, the ramp 231 may define a sloped or tapered outer diameter which decreases in size from an uphole end portion of the ramp 231 to a downhole end portion of the ramp 231. In one example, the difference in radial position between uphole and end portions of the ramp 231 may range from 1/64 inch (0.4 mm) to 4 inches (102 mm). More particularly, the decrease in radial position of the upper and lower end portions of the ramp 231, relative to the longitudinal axis 233, may be within a range that includes lower and/or upper limits including any of 1/32 inch (0.8 mm), 1/16 inch (1.6 mm), 1/8 inch (3.2 mm), 1/4 inch (6.4 mm), 1/2 inch (12.7 mm), 3/4 inch (19.1 mm), 1 inch (25.4 mm), 1 1/2 inches (38.1 mm), 2 inches (50.8 mm), 3 inches (76.2 mm), 4 inches (101.6 mm), and values therebetween. Accordingly, the difference in radial position between the upper and lower end portions of the ramp 231, may be between 1/32 inch (0.8 mm) and 1 inch (25.4 mm) in some embodiments. More particularly still, the decrease in size may range from 1/32 inch (0.8 mm) to 1/4 inch (6 mm) or from 1/16 inch (1.6 mm) to 1/8 inch (3.2 mm). In other embodiments, the change in radius across a length of the ramp 231 may be less than 1/32 inch (0.8 mm) or more than 4 inches (101.6 mm). Rather than expressing size differences in terms of radial position, the size difference may be expressed in terms of changes in diameter of the body 213 along the ramps 231. For instance, where a radial change of a ramp is between 1/32 inch (0.8 mm) and 1 inch (25.4 mm), the change in diameter may be between 1/16 inch (1.6 mm) and 2 inches (50.8 mm). In some embodiments, the change in radius or diameter of the tracks 230 and the ramps 231 may correspond to a change in an outer radius or diameter of blades 216 of a follow mill 208

As shown in FIGS. 2-2 and 3, each track 230 may include two rails 232—one formed or otherwise included on each lateral side of the corresponding ramp 231. In a particular embodiment, the rails 232 may radially protrude from the body 213, and the ramp 231 may be located between the two rails 232. In some embodiments, the rails 232 may be sloped. Optionally, the slope of the rails 232 may generally correspond to the slope of the ramps 231. In some embodiments, the ramp 231 may include a slot, groove, or other recess in the body 213, and the rails 232 may generally define side surfaces around the recess.

The rails 232 on either side of the ramp 231 may include unfastened, or open rail portions 234 and fastened, or closed rail portions 235 in some embodiments. As further described herein, the closed rail portions 235 may be configured to secure a blade 216 to the body 213, while the open rail portions 234 optionally may not, or vice versa. The portion of the ramp 231 bordered by one or more closed rail portions 235 may be referred to as a closed ramp portion 236, while the portion of the ramp 231 bordered by one or more open rail portions 234 may be referred to as an open ramp portion 237. In some embodiments, a total axial length of the ramp 231 (or a rail 232) may be at least twice as large as an axial length of the closed ramp portion 236 (or a closed rail portion 235). In one example, an axial length of the closed rail portion 235 may be between 1/4 inch (6.4 mm) and 10 inches (254.0 mm). More particularly, the axial length of the closed rail portion 235 may be within a range having lower and/or upper limits that include any of 1/4 inch (6.4 mm), 3/8 inch (9.5 mm), 1/2 inch (12.7 mm), 5/8 inch (15.9 mm), 3/4 inch (19.1 mm), 1 inch (25.4 mm), 1 1/2 inches (38.1 mm), 2 inches (50.8 mm), 3 inches (76.2 mm), 5 inches (127.0 mm), 10 inches (254.0 mm), or values therebetween. In other embodiments, the length of the closed rail portion 235 may be less than 1/4 inch (6.4 mm) or more than 10 inches (254.0 mm).

According to at least some embodiments, the length of the ramp 231 may be less than twice the length of the closed ramp portion 236, or may be more than twice the length of the closed ramp portion 236. For instance, in some embodiments, the closed ramp portion 236 may have a length that is between 10% and 100% of the length of the ramp 231. More particularly, the closed ramp portion 236 may have a length that is within a range having lower and/or upper limits that include 10%, 15%, 20%, 25%, 30%, 40%, 50%, 60% 75%, 80%, 90%, 95%, 100%, or values therebetween, relative to the length of the ramp 231. Accordingly, if the closed rail portion 235 is 80% as long as the ramp 231, and the closed rail portion 235 (and thus closed ramp portion 236) has a length of 2 inches (50.8 mm), the length of the ramp 231 may be 2 1/2 inches (63.5 mm).

In some embodiments, the closed rail portions 235 and the closed ramp portions 236 may refer to portions of the tracks 230 where the blades 216 are coupled to the body 213 in a manner that resists at least some radial movement of the blades 216 relative to the body 213. For instance, the closed rails portions 235 may each have a fastener 238 thereon, while the open rail portions 234 may not include such a fastener 238. The fastener 238 may be configured to couple the blade 216 to the body 213. For instance, the fastener 238 may be used to restrict at least some radial movement of the blades 216 relative to the body 213, while allowing at least some axial movement of the blades 216 relative to the body 213. In some embodiments, the fastener 238 may protrude laterally inwardly from one or both closed rail portions 235 adjacent the closed ramp portion 236 (see FIG. 4-2), to resist, and potentially prevent, the blade 216 from being pulled radially outward from (or inserted radially inward into) the closed ram portion 236. At the open rail portions 234 adjacent the open ramp portions 237, the fasteners 238 may not be included, and may thus not restrict or prevent radially inward or outward movement of the blades 216.

In some embodiments, an open ramp portion 237 may have a greater diameter than a closed ramp portion 236. In other embodiments, the closed ramp portion 236 may have a greater diameter than an open ramp portion 237. In some embodiments, where the ramp 231 decreases in radial size in a downhole direction, the open rail portion 234 may be positioned uphole relative to the closed rail portion 235. In the same or other embodiments, the ramp 231 may increase in radial size in the downhole direction and/or the open rail portion 234 may be downhole relative to the closed rail portion 235. In some embodiments, a full or partial length of one or more of the open ramp portion 237 or the closed ramp portion 236 may not be sloped, or may have a slope that differs from a slope of the other of the closed ramp portion 236 or the open ramp portion 237.

As discussed herein, the ramps 231 and the rails 232 may be configured to allow the blades 216 to be adjusted, so as to have different radial and/or axial positions. In some embodiments, the ramps 231 may include a ramp shoulder 239. The ramp shoulders 239 may be formed at or near downhole end portions of the ramps 231. In some embodiments, the ramp shoulders 239 may be formed at or near where a smallest outer diameter of the closed ramp portion 236 ends (e.g., meets the outer diameter of the body 213). Once the blades 216 contact the ramp shoulders 239, the blades 216 may be restricted, or even prevented, from further axial movement in a downhole direction.

Figures 1, 4:
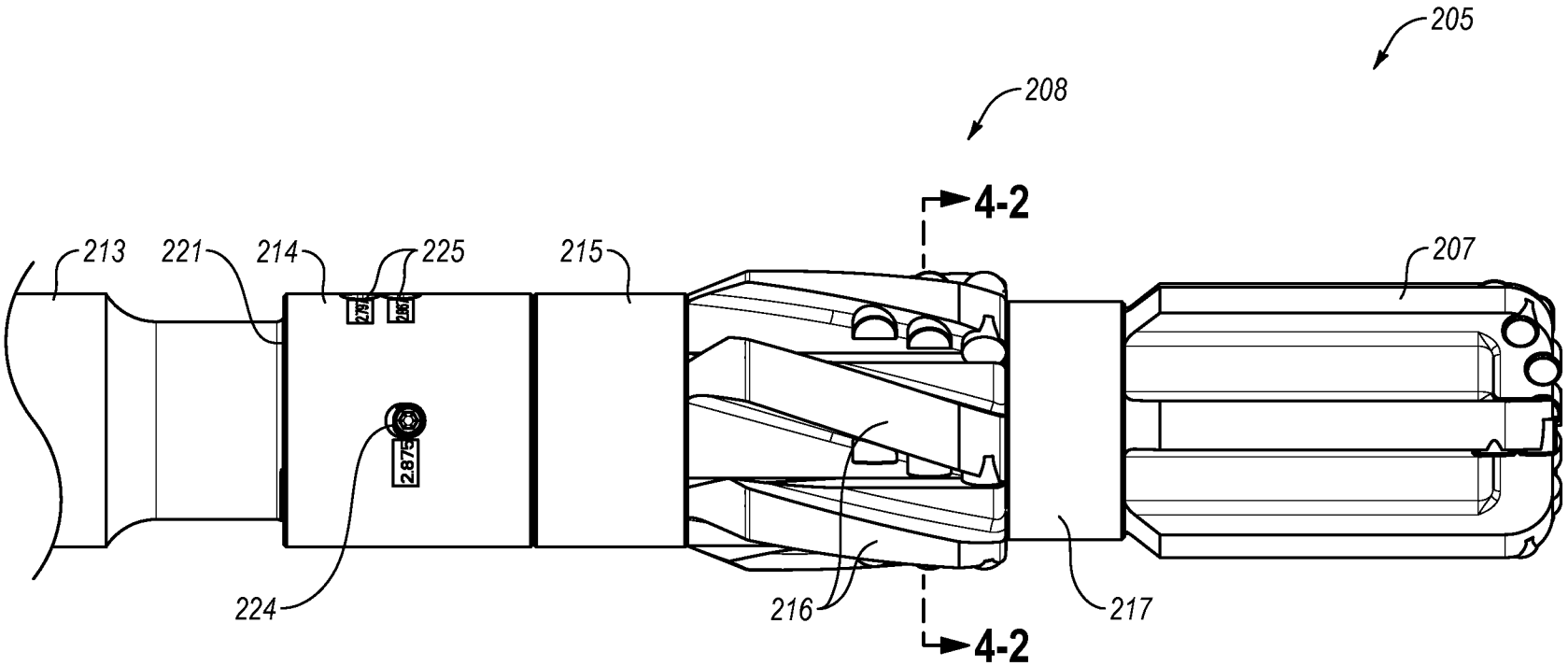
Figures 2, 4:
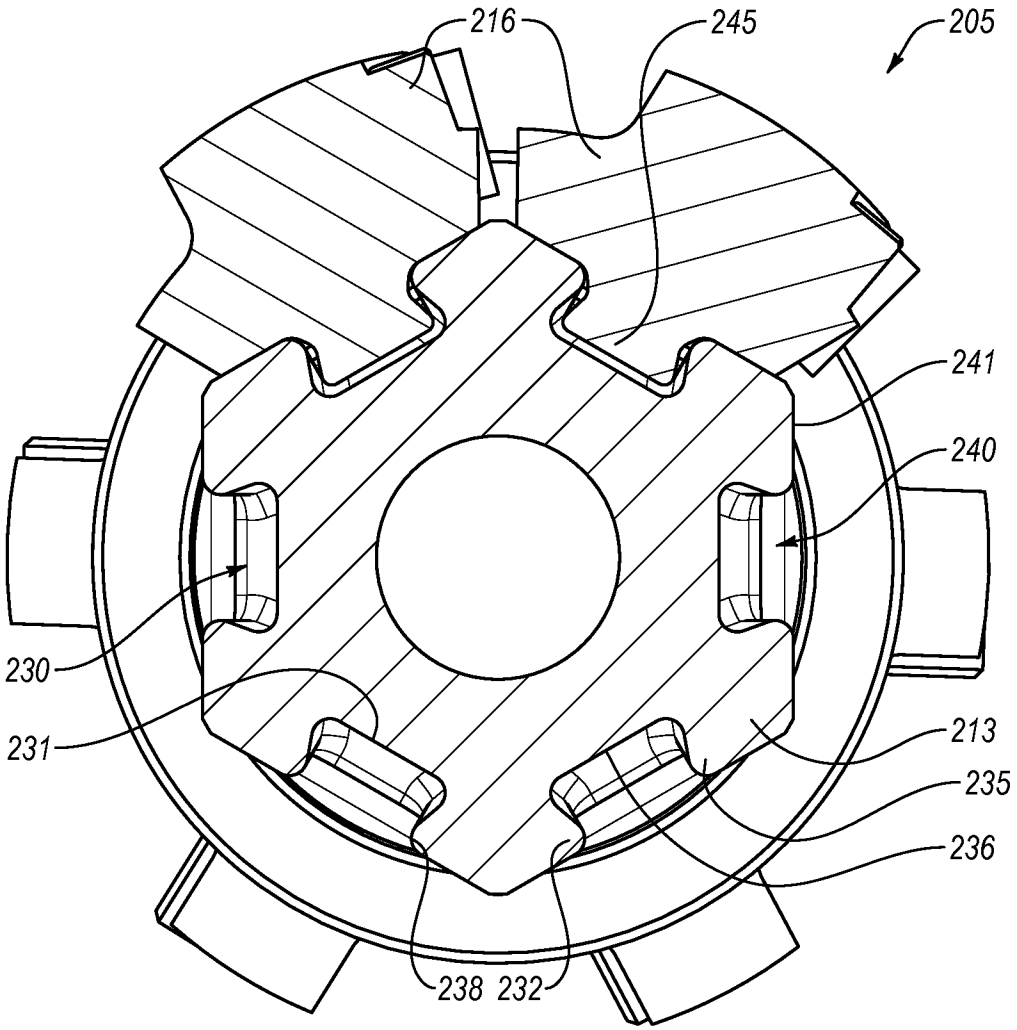

FIGS. 4-1 and 4-2 are side and cross-sectional views, respectively, of the mill 205 of FIGS. 2-1 and 2-2. As discussed herein, the mill 205 may be selectively expandable, and FIGS. 4-1 and 4-2 illustrate an example embodiment in which the blades 216 are in an expanded state or position. In this particular embodiment, the blades 216 may be axially offset from the ramp shoulders 239 (see FIG. 3) when in the expanded state.

The mill 205 may be assembled by coupling the locking collar 214, first and second spacers 215, 217, blades 216, and lead mill 207 to the body 213. As seen in FIG. 4-1, the locking collar 214 may be threadingly engaged with the second threads 221, and an indicator screw 224 may be coupled to the body 213 and the locking collar 214. This may be done by, for instance, aligning one of the indicator openings 225 on the locking collar 214 with the threaded opening 223 (see FIG. 2-2) on the body 213. When the particular indicator opening 225 is aligned in this manner, it may correspond to an expanded (and potentially maximum expanded or maximum diameter) state or position of the blades 216.

In the expanded state shown in FIG. 4-1, the blades 216 may be locked to the body 213. FIG. 4-2, for instance, is a cross-sectional view of the body 213 of the mill 205, and shows example fasteners 238, the closed rail portions 235, and the closed ramp portion 236 in one manner that may radially lock the blades 216 to the body 213. In this particular embodiment, the closed rail portions 235 and the closed ramp portion 236 may define a recess, slot, groove, or other channel 240, which may generally be a T-slot channel, a U-slot channel, dovetail channel, a socket, another other suitable configuration, or any combinations of the foregoing. A surface on the outer diameter of each closed rail portion 235 may be referred to as a rail face 241. In some embodiments, the rail face 241 may be substantially flat or planar, while in other embodiments the rail face 241 may be curved or otherwise contoured. Optionally, the rail face 241 may be substantially parallel to the closed ramp portion 236, which may define an inner surface of at least a portion of the channel 240.

In this particular embodiment, the first and second spacers 215, 217 may be adjacent the uphole and downhole end portions of the blades 216, and may restrict or even prevent axial movement of the blades 216, while the fasteners 238 may restrict or even prevent radial movement of the blades 216. The locking collar 214 may also be locked in place, and may restrict or limit axial movement of the first spacer 215, which may be axially between the blades 216 and the locking collar 214. The lead mill 207 or other locking head may be coupled to the body 213 at a downhole location (e.g., using a threaded connection). The lead mill 207 may be adjacent the second spacer 217. By coupling the lead mill 207 and the locking collar 214 in place, the axial position of the blades 216 may thereby be fixed.

Figures 1, 5:
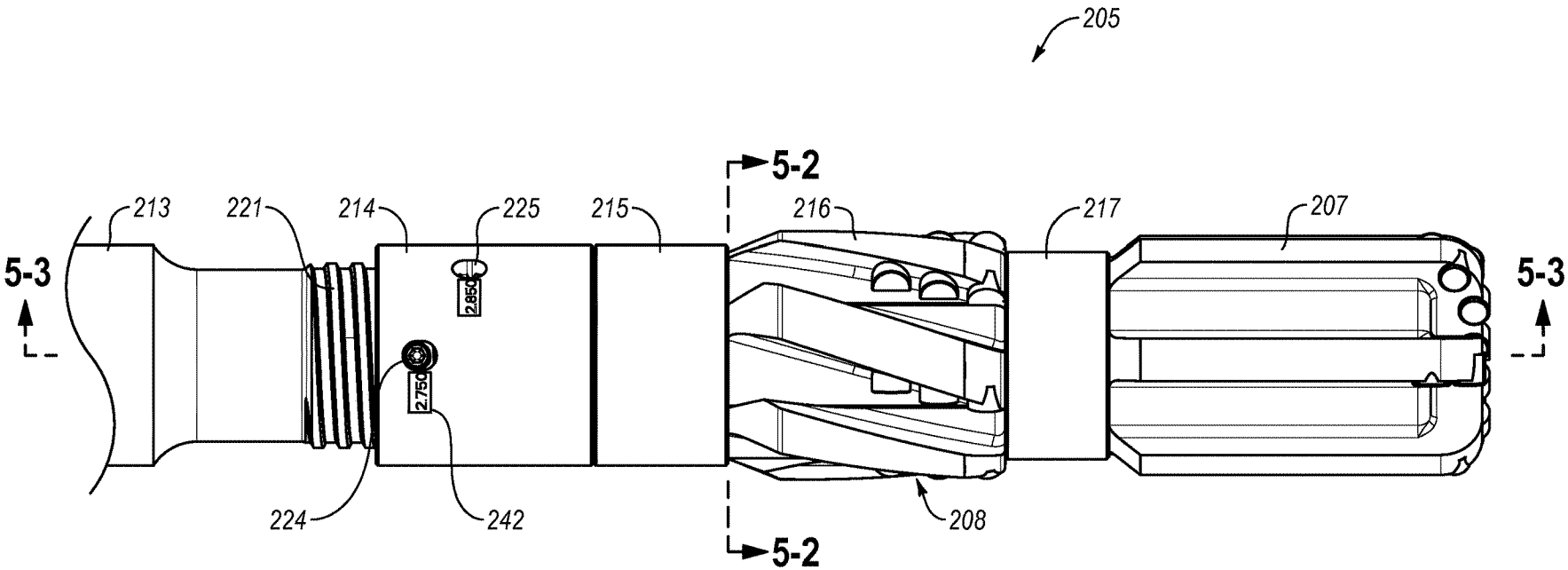
Figures 2, 5:
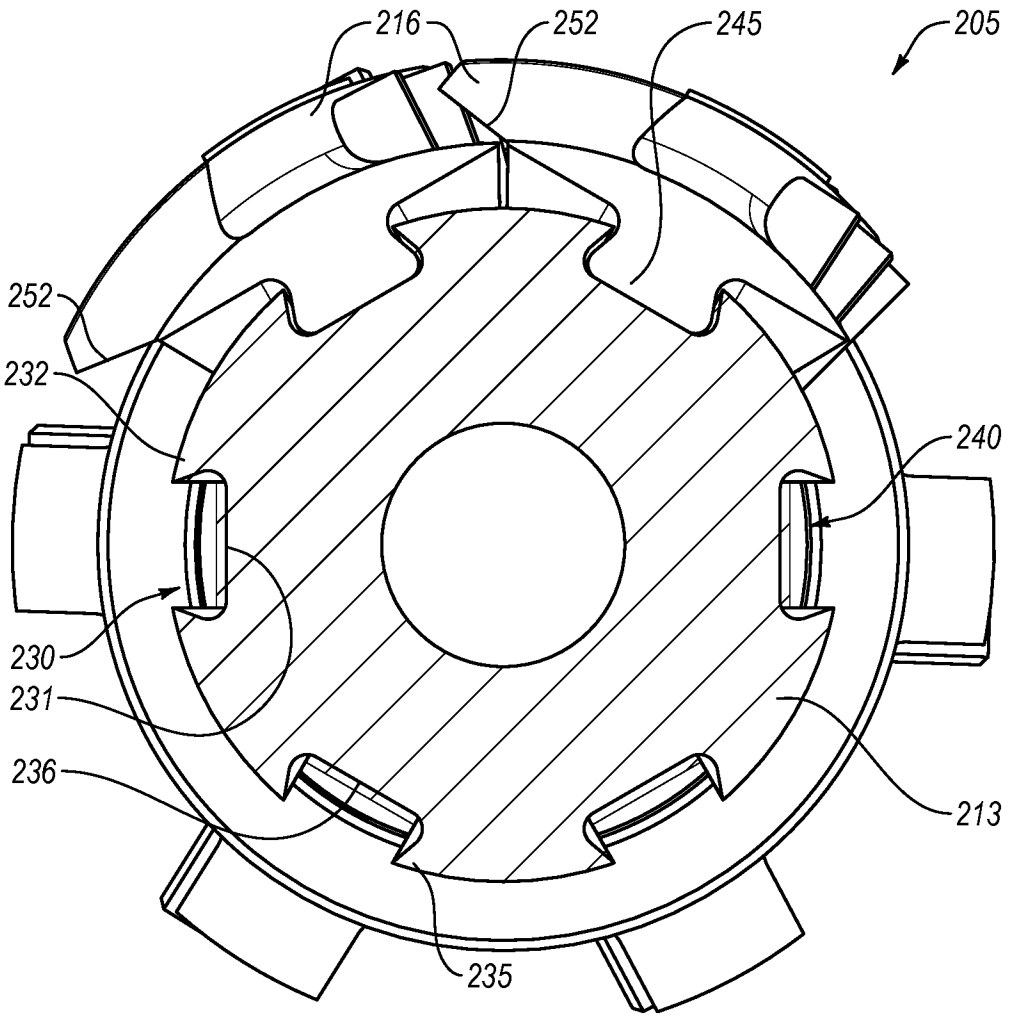
Figures 3, 5:
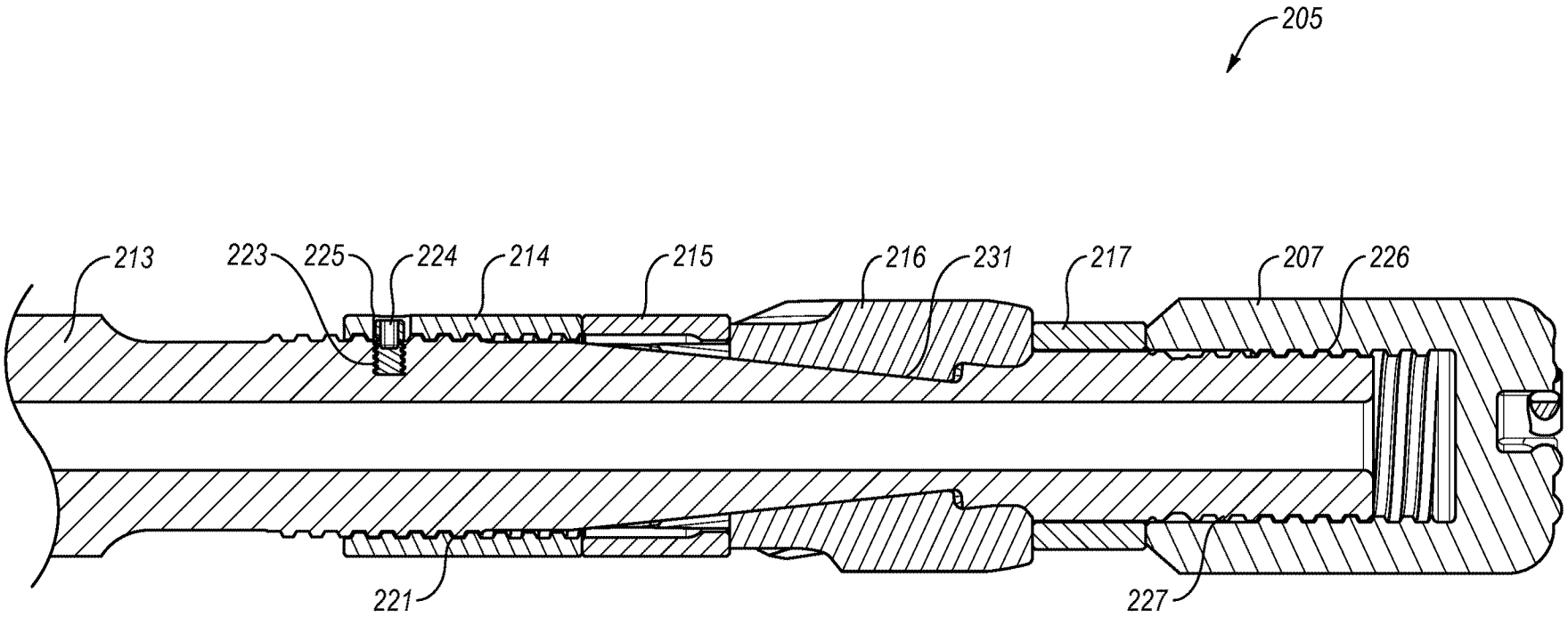

FIGS. 5-1 to 5-3 illustrate another example embodiment of the mill 205. More particularly, in this embodiment, the blades 216 of the mill 205 have been moved axially and radially from the position shown in FIGS. 4-1 and 4-2, and are in a retracted or reduced diameter state or position. The retracted state of the blades 216 may correspond to a minimum diameter of the blades 216 in some embodiments.

More particularly, the mill 205 may have been fully or partially disassembled, or otherwise adjusted, to allow the blades 216 to move axially along the ramps 231 and the rails 232, and to thereby also move radially inward. As seen in FIGS. 5-1 and 5-3, for example, the locking collar 214 may be moved in an axially downward direction relative to the position shown in FIG. 4-1. In this position, the locking collar 214 may optionally remain engaged with the second threads 221. The indicator screw 224 may be coupled to the body 213 (e.g., in the threaded opening 223) and the locking collar 214 (e.g., in an indicator opening 225). This may be done by, for instance, aligning the threaded opening 223 with a different indicator opening 225 than used in the expanded state of the mill 205 shown in FIG. 4-1. When the particular indicator opening 225 is aligned in this manner, it may correspond to a retracted (and potentially most retracted or minimum diameter) state or position of the blades 216.

Each indicator opening 225 may occupy a unique position on the locking collar 214. In particular, each indicator opening 225 may be located at a different axial length from the downhole end portion of the locking collar 214. Accordingly, the indicator openings 225 may be used to position the locking collar at different axial positions on the body 213. In effect, the different indicator openings 225 may be used to vary how far uphole or downhole the locking collar 214 (and thus the first and second spacers 215, 217, blades 216, and lead mill 207) may be positioned with respect to the body 213. An axial position of the locking collar 214 (e.g., measured as the position of the downhole end portion of the locking collar 214) may be referred to as a locking position of the locking collar 214.

Each indicator opening 225 may be associated with a different locking position. Accordingly, the locking collar 214 may be set at a selected locking position by securing the locking collar 214 using an indicator opening 225 associated with the selected locking position. For example, in some embodiments, the locking collar 214 may be set to its most uphole locking position (corresponding here to the most expanded position of the blades 216) by securing the locking collar 214 using its most downhole indicator opening 225. Conversely, the locking collar 214 may be set to its most downhole locking position (corresponding here to a most retracted position of the blades 216) by affixing the locking collar 214 using its most uphole indicator opening 225. The locking collar 214 may also be set to positions between the most downhole and uphole positions. In some embodiments, the indicator openings 225 may define multiple discrete locking positions. In some embodiments, two or more indicator openings 225 may have a same angular or circumferential position on the locking collar 214, but different axial positions.

In the illustrated embodiment, by moving the locking collar 214 axially, the first spacer 215, the second spacer 217, and the lead mill 207 may each also move in a downward direction. As seen in FIG. 5-3, the lead mill 207 may remain threadably engaged with the third threads 226 of the body 213; however, the lead mill 207 potentially may not bottom out on the third threads 226 (or may have fewer threads engaged as compared to an expanded position). By moving the various other components of the mill 205, the blades 216 may also move axially along the body 213. As discussed herein, the blades 216 may be guided by one or more ramps 231 and/or rails 232 (see FIG. 5-2). Where the ramps 231 and/or rails 232 are sloped, the axial movement of the blades 216 along the body 213 may also cause the blades 216 to move axially. In this embodiment, the blades 216 may move radially inward when moving axially downward, although such a relationship could also be reversed in other embodiments. As seen in FIG. 5-2, when the blades 216 are in a retracted state, the blades 216 may optionally remain coupled to the body 213 using one or more fasteners 238 which restrict radial movement of the blades 216. The fasteners 238 may therefore restrict radial movement of the blades 216 while the locking collar 214, indicator screw 224, and lead mill 207 (optionally with the first and second spacers 215, 217) restrict axial movement of the blades 216.

As will be appreciated by those of ordinary skill in the art having benefit of the present disclosure, the locking collar 214 may be moveably coupled to the body 213. In some embodiments, the locking collar 214 may be substantially cylindrical and configured to engage the second threads 221 using its internal threads 227. By rotating the locking collar 214, each of the plurality of indicator openings 225 may be selectively aligned with the threaded opening 223. By inserting the indicator screw 224 through one of the indicator openings 225 and into the threaded opening 223, the locking collar 214 can be rotationally and axially locked to the body 213. In some embodiments, the indicator screw 224, indicator openings 225, and the threaded opening 223 may each be threaded. In other embodiments, one or more of the indicator screw 224, indicator openings 225, or threaded opening 223 may not be threaded. In other embodiments, the locking collar 214 may be constrained to the body 213 using other or additional fastening mechanisms. In some embodiments, the indicator screw 224 may be about even with, or interior to, an outer surface of the locking collar 214 so that the indicator screw 224 does not radially protrude from the locking collar 214 when the locking collar 214 is coupled to the body 213. In other embodiments, the indicator screw 224 may radially protrude from the locking collar 214.

In some embodiments, and as shown in FIG. 5-1, the locking collar 214 may include indicia 242 at or near each indicator opening 225. The indicia 242 may indicate any of a number of different types of information. For instance, the indicia 242 may indicate an outer diameter size for that particular indicator opening 225. Such outer diameter may be the outer diameter of the ramps 231 or rails 232, or the outer diameter (e.g., gauge diameter) of the blades 216. The indicia 242 may be provided by etching, printing, embossing, other techniques, or combinations of the foregoing.

Figures 1, 6:
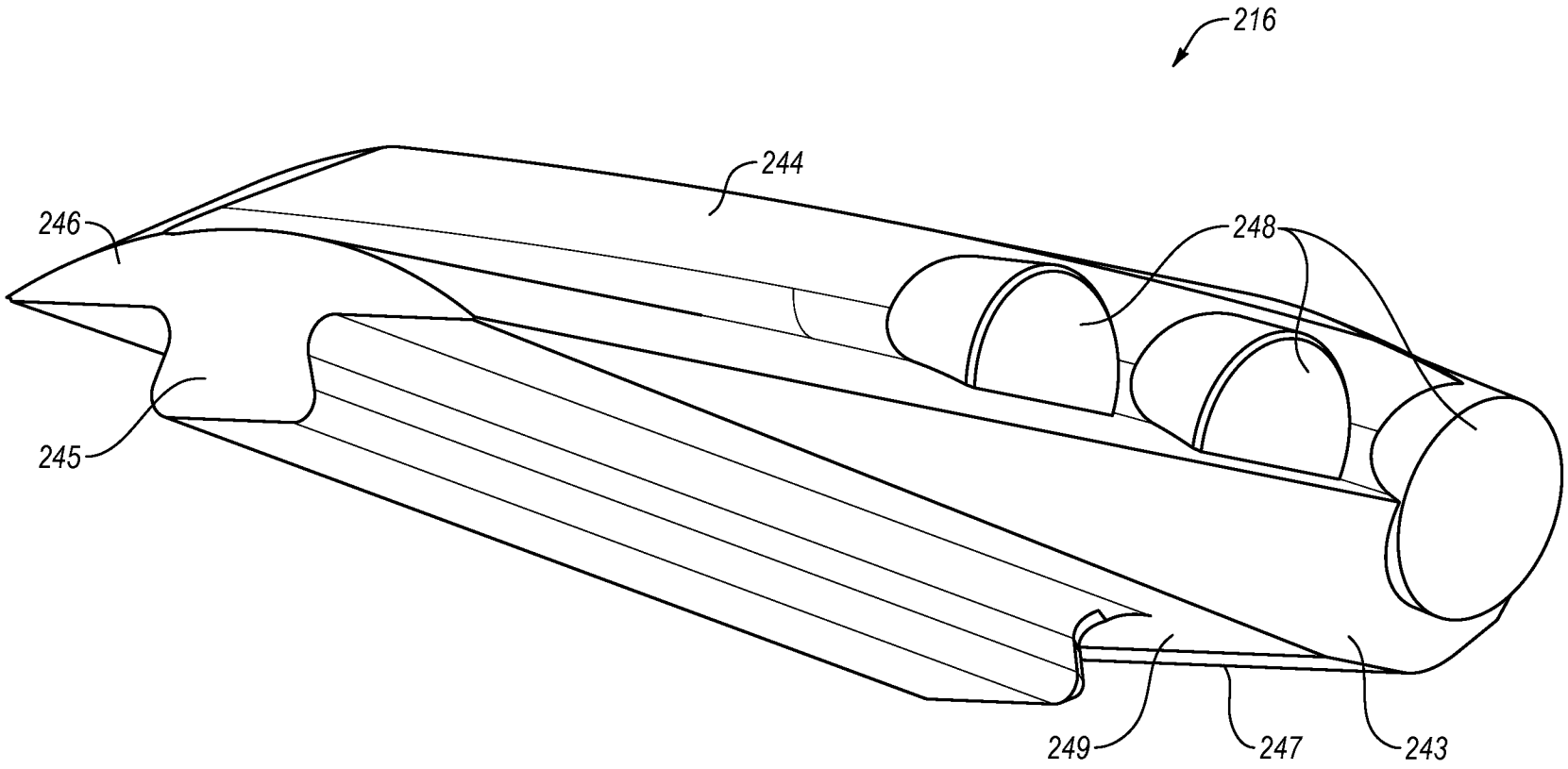
Figures 2, 6:
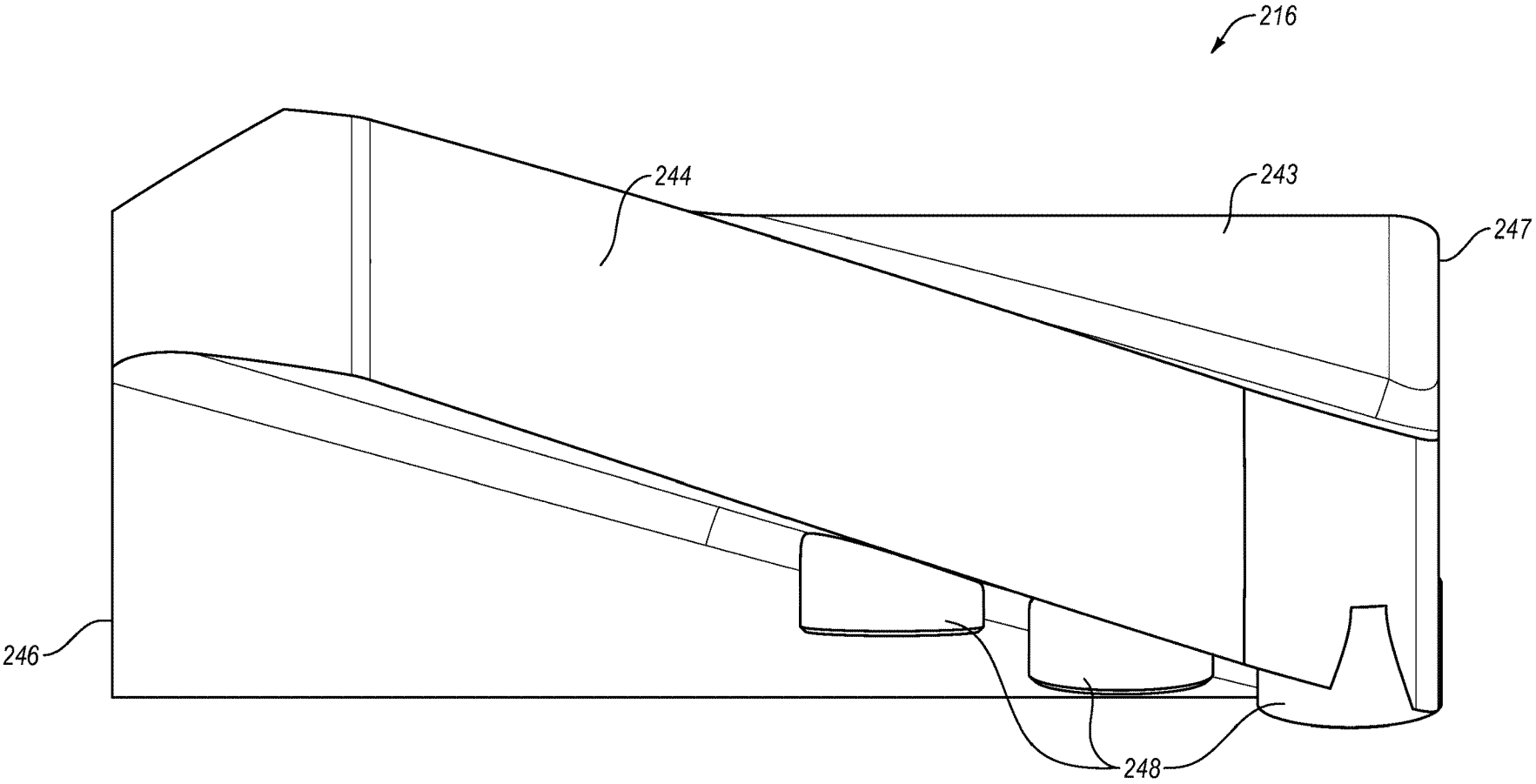

A blade 216 used in connection with a downhole tool or mill of the present disclosure may have any number of different forms. FIGS. 6-1 and 6-2 are illustrative views of an example blade 216 according to some embodiments of the present disclosure. In particular, FIG. 6-1 is a perspective view, and FIG. 6-2 is a top view, of the blade 216 of the embodiment shown in FIGS. 2-1 to 5-3.

As shown in FIGS. 6-1 and 6-2, a blade 216 according to some embodiments of the present disclosure may include a base 243, a cutting structure 244, and a blade fastener 245. In some embodiments, the cutting structure 244 may protrude from a top surface of the base 243. The top surface may represent a side of the blade 216 which faces radially outward and away from the body 213 (see FIG. 5-3) when the blade 216 is coupled to a track 230 (see FIG. 5-2). In some embodiments, the cutting structure 244 may be arranged to define a generally helical shaped structure along the top surface of the base 243. The cutting structure 244 may run from (or between) an uphole end portion 246 to a downhole end portion 247 of the blade 216. In some embodiments, the cutting structure 244 may include one or more cutting elements 248 coupled thereto. The cutting elements 248 may, in some embodiments, be composed of a superhard or superabrasive material (e.g., tungsten carbide, natural diamond, polycrystalline diamond compact ("PDC"), cubic-boron-nitride, or other materials), some other cutting elements, or some combination thereof. In at least some embodiments, the cutting elements 248 may be coupled to the cutting structure 244 using a brazing, welding or other technique. For instance, one or more pockets may be formed in the cutting structure 244, and the cutting elements 248 may be brazed within the pockets. In other embodiments, the cutting elements 248 may be coupled to the cutting structure 244 in other manners (e.g., applied as hardfacing, crushed carbide, etc.), or may be excluded. The cutting structure 244 and/or the cutting elements 248 may therefore be made of any suitable material known to those skilled in the art in view of the disclosure herein. In some embodiments, the top surface of the base 243 and/or the cutting structure 244 may have a general curvature, may be generally planar, or may have multiple sections that are planar, curved, or have some combination thereof.

In some embodiments, the blade fastener 245 may protrude from a bottom surface of the base 243. The bottom surface may represent a side of the blade 216 which faces radially inwardly and toward the body 213 (see FIG. 5-3) when the blade 216 is coupled to the track 230 (see FIG. 5-2). The bottom surface of the base 243 may also be referred to as a blade face 249. In one or more embodiments, the blade face 249 may be substantially flat or planar, while in other embodiments the blade face 249 may be curved or have multiple curved and/or planar sections. Optionally, the blade face 249 may be substantially parallel relative to a bottom surface of the blade fastener 245; however, the blade face 249 may also be angled or otherwise non-parallel relative to the bottom surface of the blade fastener 245.

The blade fastener 245 may be of a size and/or shape such that it may engage with a track 230 (see FIG. 5-2), as described herein. In some embodiments, the blade fastener 245 may extend fully from the uphole end portion 246 to the downhole end portion 247 of the base 243. In other embodiments, including the embodiments shown in FIG. 6-1, the blade fastener 245 may have a shorter axial length than that of the base 243.

Figures 1, 7:
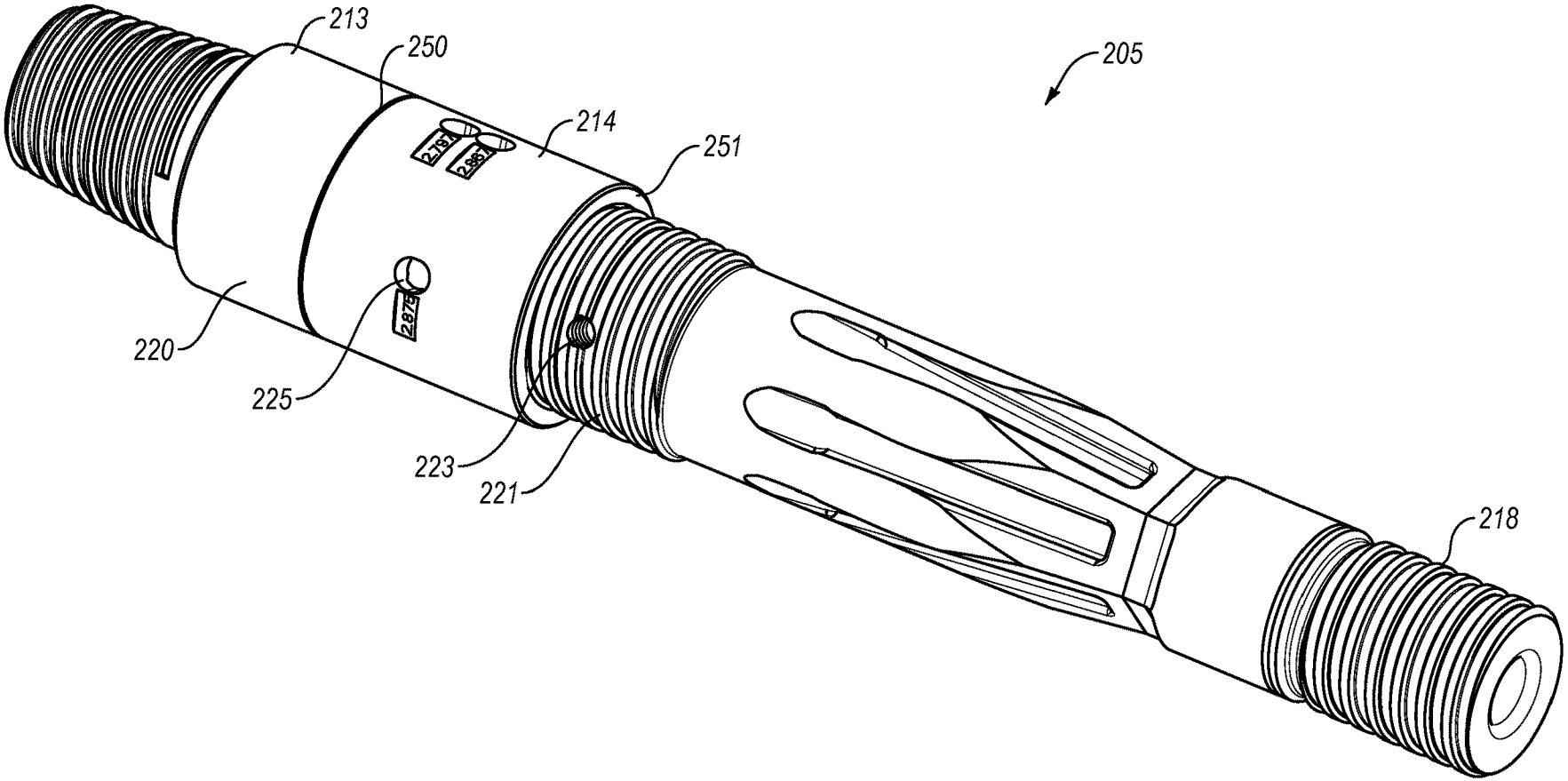
Figures 2, 7:
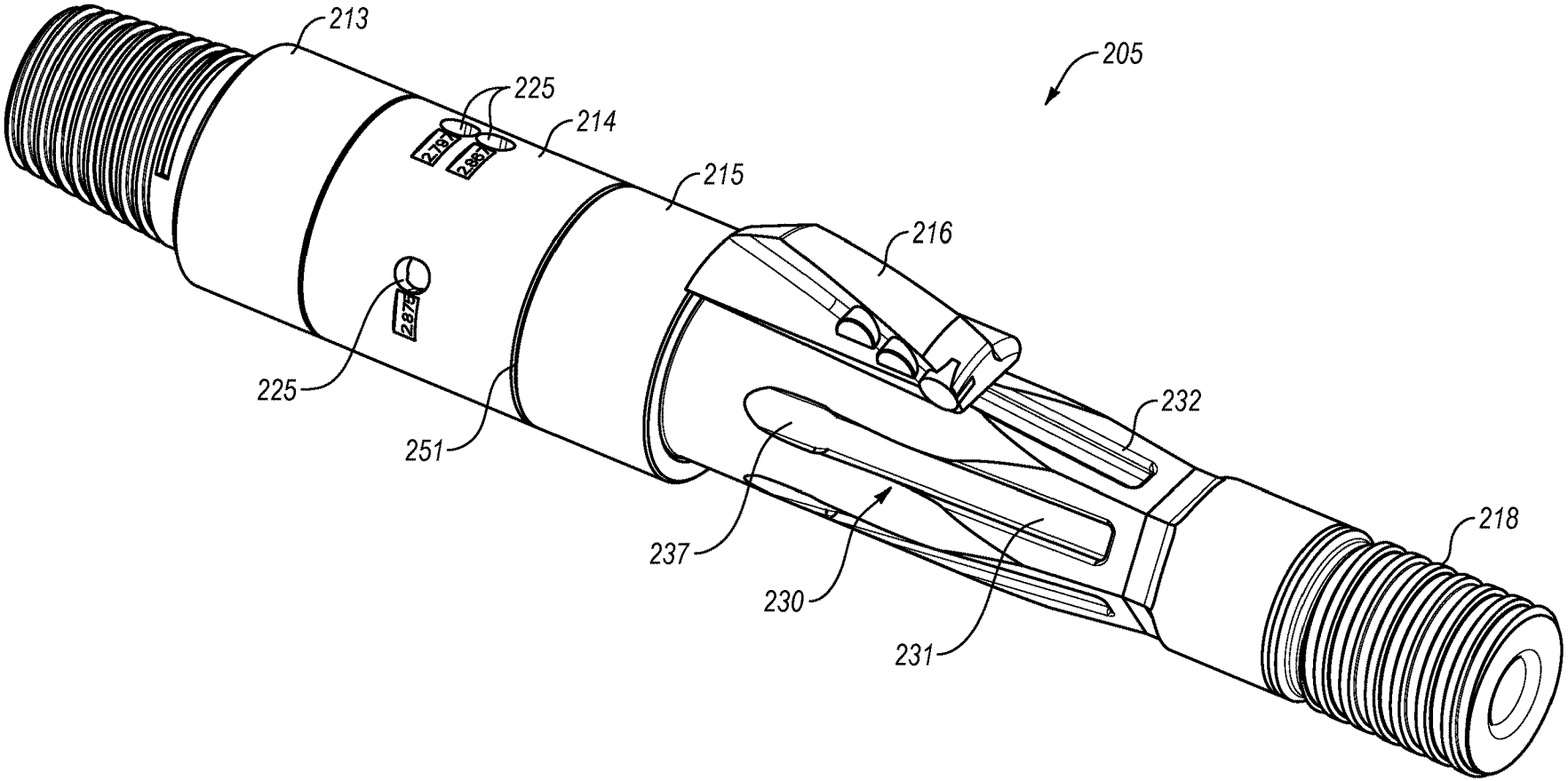
Figures 3, 7:
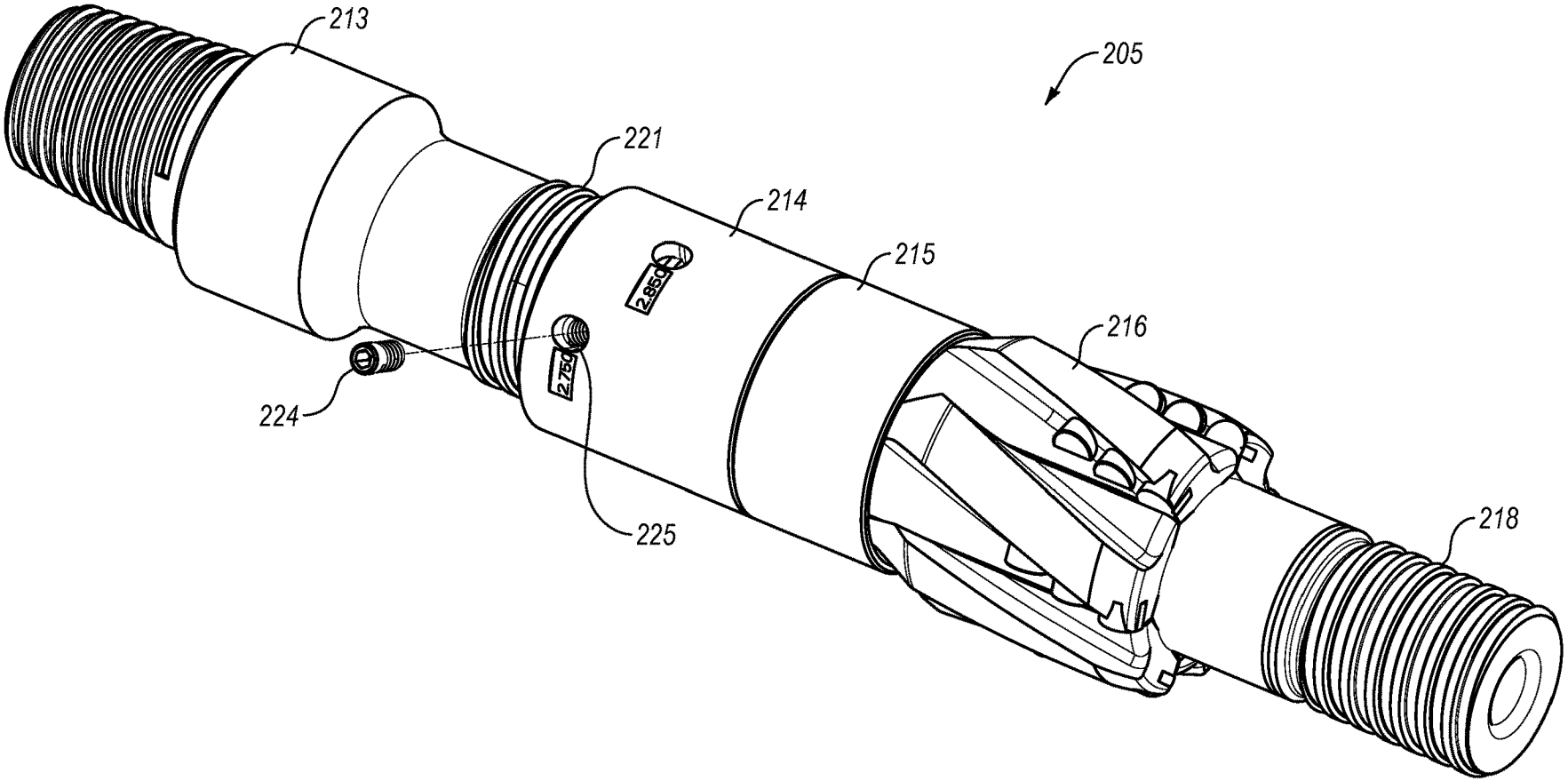

Turning now to FIGS. 7-1 to 7-3, the mill 205 will be described with additional detail, and particularly with respect to an example method for assembling and/or adjusting the mill 205. In particular, the locking collar 214 may be configured to have an uphole (or proximal) end portion 250 and a downhole (or distal) end portion 251. In some embodiments, such as that in FIG. 7-1, the locking collar 214 may initially be positioned on the mill 205 by sliding the respective locking collar 214 to a desired position from a downhole end portion 218 of the body 213.

More particularly, during assembly of the mill 205, the locking collar 214 may initially be moved to an uphole (or proximal) position, and potentially to a position as far uphole as possible on the body 213. Such a position may allow sufficient space for other components of the mill 205 to also be placed on the body 213. In FIG. 7-1, the locking collar 214 is shown as being positioned on the body 213, and optionally abutting a downhole end of the shoulder 220. In such an embodiment, the locking collar 214 may optionally be positioned uphole relative to the threaded opening 223 and/or some or even each indicator opening 225 may be positioned uphole of the threaded opening 223.

During further assembly of the mill 205, the first spacer 215 (see FIG. 7-2) may be placed on the body 213. The first spacer 215 may be have a bore therein, and the body 213 (e.g., the downhole end portion 218) may initially be received within the first spacer 215. The first spacer 215 may then be moved in an uphole direction toward the locking collar 214. An uphole end portion or face of the first spacer 215 optionally may abut the downhole end portion 251 of the locking collar 214, as illustrated in FIG. 7-2.

In continuing the assembly of the mill 205, once the locking collar 214 and the first spacer 215 are placed on the body 213, one or more of the blades 216 may be coupled to the body 213. In particular, in some embodiments the blades 216 may be coupled to tracks 230 of the body 213. Optionally, the number of blades 216 may equal the number of tracks 230.

A blade 216 may initially be placed on a track 230 once the locking collar 214 and/or the first spacer 215 have been placed on the body 213. As shown in FIG. 7-2, for instance, when the locking collar 214 and the first spacer 215 are positioned on the body 213, an open ramp portion 237 of the tracks 230 may be exposed. When coupling the blade 216 to the body 213, the blade 216 may be initially placed on the ramp 231 of the track 230. In particular, the blade fastener 245 (see FIG. 6-1) of the blade 216 may be placed proximate to the open ramp portion 237, which may correspond to a location of the ramp 231 having the largest outer diameter.

In such a scenario, the bottom of the blade fastener 245 (see FIG. 6-1) may initially be seated on the ramp 231 between two open rail portions 234 (see FIG. 3). The blade face 249 (see FIG. 6-1) may be placed on an outer surface body 213 adjacent the open rail portions 234. In such a configuration, the blade 216 may be freely movable and generally unconstrained in a radially-outward direction. In some embodiments, and as shown in FIG. 7-2, where the open ramp portion 237 is at a proximate or uphole end portion of the ramp 231, the blade 216 may initially be placed at the uphole end portion of the ramp 231.

In continuing the assembly of the mill 205, and as shown in FIG. 7-3, the blades 216 may be moved in the downhole direction along the ramps 231 of the tracks 230. Such movement may continue until the locking collar 214 and the first spacer 215 have sufficient space on the body 213 to move in a downhole direction to a location where the locking collar 214 may align with the threaded opening 223 (see FIG. 2-2), as described herein. In some embodiments, in moving the blades 216 along the tracks 230, the blades 216 may become coupled to the track 230. For instance, as shown in FIG. 5-2, a blade fastener 245 may slide or otherwise move into the channel 240, and the blade fastener 245 may be constrained by the closed rail portions 235, the closed ramp portion 236, the fasteners 238, or other components, or some combination thereof. In some embodiments, the fasteners 238 may be protrusions extending in a circumferential direction from the rails 232 so as to align with corresponding recesses, slots, grooves, or other features in the blade fasteners 245. Thus, when the blade fastener 245 is within the channel 240, an interlock between a fastener 238 and blade fastener 245 may retain the blades 216 within the channel 240 and coupled to the body 213. More particularly, the blade fastener 245 and the channel 240 may be of a complementary size and/or shape, thereby allowing the blade fastener 245 to engage with the closed rail portions 235, the closed ramp portion 236, the fasteners 238, or some combination thereof. For example, the blade fastener 245 and the channel 240 may both be complementary features of a T-slot configuration, a U-slot configuration, a dovetail configuration, or the like. In some embodiments, the blade fastener 245 may include a slot or channel, and the channel 240 may be replaced by a protrusion or rail.

In some embodiments, the closed rail portions 235 may have a greater axial length than that of the blade fasteners 245. In some embodiments, when moved from an open ramp portion 237 (see FIG. 3) and into the channel 240, the entire blade fastener 245 may potentially be bounded by the closed rail portions 235 (or bounded by portions of both the closed rail portions 235 and the open rail portions 234). When the blade 216 is coupled to the track 230, lateral movement of the blade 216 may be restricted, and potentially prevented, by an engagement of the closed rail portions 235 with the blade fasteners 245. In addition, radial movement of the blade 216 may be limited, and potentially prevented, by an engagement of the fasteners 238 with the blade fasteners 245.

In addition, once the blade 216 is coupled to the track 230, the blade face 249 (see FIG. 6-1) may be seated against the rail faces 241. In some embodiments, the blade faces 249 and the rail faces 241 may be substantially parallel. In another embodiment, the blade faces 249 may have enough surface area to substantially cover the rail faces 241. In addition, the bottom surface of the blade fastener 245 may be seated against the outer surface of the closed ramp portion 236. In some embodiments, the bottom surface of the blade fastener 245 and the outer surface of the closed ramp portion 236 may be substantially parallel.

A plurality of blades 216 may be used, and each may optionally be of a similar size and/or shape. Accordingly, each blade 216 may be coupled to a respective track 230 in a similar manner, until the plurality of blades 216 are fully coupled to the body 213. In some embodiments, the plurality of blades 216 may provide about 360° blade coverage around the body 213. In such an embodiment, one blade 216 may overlap over a neighboring blade 216, such as illustrated in FIG. 5-2. For example, the cutting structure 244 may extend laterally beyond its base 243 and jut out over a base 243 of a neighboring blade 216.

To avoid interference with a neighboring blade 216, a blade 216 may include a relief portion 252. The relief portion 252 may include a portion of the blade 216 having material removed from the cutting structure 244 and/or the base 243 to avoid interference with a neighboring base 243. The plurality of blades 216 may provide 360° blade coverage at different gauge diameters of the blades, in accordance with embodiments disclosed herein. In other embodiments, less than 360° coverage may be provided. For instance, the blades 216 may provide coverage for between 50% (180° and 100% (360° of the body 213. Where the blades 216 provide coverage for less than 360° of the body 213, multiple portions between adjacent blades 216 may not be covered, rather than as a continuous section not covered.

Referring again to FIGS. 4-2 and 5-2, a plurality of blades 216 of a mill 205 may move between a most uphole axial position or a position corresponding to a maximum or extended gauge diameter (FIG. 4-2) and a most downhole position or a position corresponding to a minimum or retracted gauge diameter (FIG. 5-2). In some embodiments, the plurality of blades 216 may maintain 360° degree coverage at each axial position between the most uphole and most downhole axial positions. In one example, the maximum outer diameter and the minimum outer diameter of the blades 216 may differ by between ⅛ inch (3.2 mm) and 10 inches (254.0 mm). For instance, the difference in minimum and maximum outer diameters may vary from ⅛ inch (3.2 mm) to ¾ inch (19.1 mm), from ⅛ inch (3.2 mm) to ½ inch (12.7 mm), from 0.2 inch (5.1 mm) to 0.4 inch (10.2 mm), or from 0.2 inch (5.1 mm) to 0.3 inch (7.6 mm). For instance, the difference in diameter may be about ¼ inch (6.4 mm). Of course, the difference in minimum and maximum outer diameters may depending on various factors, including the slope θ and/or length of the ramps 231, the size of the body 213, and the like. Thus, such dimensions are merely illustrative and can be scaled up or down based on the dimensions of various components of the mill 205.

While coupled to the tracks 230, an outer diameter of the blades 216 may vary in size based on an axial position of the blades 216. In some embodiments, the axial position of a blade 216 may be defined by an axial position of an uphole end of the blade fastener 245 on the body 213. In some embodiments, each of the plurality of blades 216 may share the same axial position on the body 213. In particular, as noted herein, the closed rail portions 235 may have a greater axial length than that of the blade fastener 245. Accordingly, a blade 216 may be able to move to different axial positions along the closed ramp portion 236 while still coupled and constrained to the track 230. As also noted herein, the outer diameter of the ramp 231 may gradually increase or decrease in size in a downhole direction. Accordingly, the outer diameter of the blade 216 may vary in a radial distance relative to a longitudinal axis of the mill 205 while coupled to the track 230 and positioned on the closed ramp portion 236, depending on where the blade 216 is located axially along the closed ramp portion 236.

For example, as illustrated in FIG. 7-3, the blades 216 may be coupled to the track 230, which includes a ramp 231 having an outer diameter that decreases in the downhole direction. The outer diameter of the blades 216 may therefore also decrease as the axial positions of the blades 216 move in the downhole direction along the ramp 231; conversely, the outer diameter of the blades 216 may increase as the blades 216 move axially in an uphole direction along the ramp 231. In such an embodiment, while coupled to the tracks 230, the blades 216 may have a maximum outer diameter at a most uphole axial position, where uphole ends of the blade fasteners 245 (see FIG. 5-2) may be aligned with uphole ends of respective closed rail portions 235 and/or closed ramp portions 236. Further, while coupled to the tracks 230, the blades 216 may have a minimum outer diameter at a most downhole axial position, where downhole ends of the blade fasteners 245 (see FIG. 5-2) may be seated against respective ramp shoulders 239 (see FIG. 3).

Returning to FIG. 7-3 and the assembly of the mill 205, after the blades 216 have been positioned to provide sufficient space for the locking collar 214 and the first spacer 215, such as by coupling the blades 216 to the tracks 230, the locking collar 214 and the first spacer 215 may then be moved in a downhole direction in order to lock the locking collar 214 to the body 213. For example, FIG. 7-3 illustrates a perspective view of the mill 205 in accordance with aspects of various embodiments described herein, where the locking collar 214 and the first spacer 215 may be moved in the downhole direction via second threads 221, such that an indicator opening 225 may align with a threaded opening 223 (see FIG. 7-1) of the body 213.

The locking collar 214 may then be axially and/or rotationally locked to the body 213 via the indicator screw 224. By moving the locking collar 214, the first spacer 215 may also move and may be positioned so that its uphole end portion optionally abuts the downhole end portion 251 of the locking collar 214. The downhole end portion of the first spacer 215 may optionally abut the uphole end portions 246 (see FIG. 6-1) of the blades 216.

As discussed herein, when assembling the mill 205, an outer diameter of the blades 216 may depend on the indicator opening 225 selected to affix the locking collar 214 at a selected locking position. In particular, the first spacer 215 may be constrained against the locking collar 214 at this selected locking position, and the blades 216 may be constrained against the first spacer 215. Accordingly, at this point, the axial position of the blades 216 on the ramp 231 may be set, thereby also setting the outer diameter of the blades 216. In some embodiments, the blades 216 may be coupled to the tracks 230, such that the axial position of the blades 216 on the closed ramp portions 236 may be set by the selected indicator opening 225 and a corresponding locking position. In this manner, each indicator opening 225 may be associated with a different outer diameter of the blades 216. As noted herein, the locking collar 214 may include an etching, marking, or other indicia 242 (see FIG. 5-1) next to each indicator opening 225 to indicate an outer diameter or other size of the blades 216 for that particular indicator opening 225. In some embodiments, the minimum outer diameter of the blades 216 may be set by the indicator opening 225 having the most uphole position on the locking collar 214. Conversely, the maximum outer diameter of the blades 216 may be set by the indicator opening 225 having the most downhole position on the locking collar 214. The opposite arrangement may also be used where, for instance, a ramp slopes inwardly in an uphole direction.

In some embodiments, during an initial assembly of the mill 205, after the first spacer 215 and the blades 216 have been constrained (e.g., against the affixed locking collar 214), the outer diameter size indicated by the indicia 242 (see FIG. 5-1) of the selected indicator opening 225 may not be equal to the actual outer diameter size of the blades 216. For instance, blades 216 of different sizes or configurations may be used. Optionally, an axial length of the first spacer 215 may be adjusted in order to move the blades 216 to the axial position corresponding to the outer diameter size indicated by the indicia 312. The axial length of the first spacer 215 may be adjusted through machining techniques known to those skilled in the art. In other embodiments, the indicia 312 may indicate positions rather than diameters or other distances/sizes.

In continuing the assembly of the mill 205, after the first spacer 215 and the blades 216 have been constrained against the affixed locking collar 214, the second spacer 217 and the lead mill 207 may be added to the mill 205, as shown in FIG. 2-1. In some embodiments, the second spacer 217 may be added to the mill 205 by sliding over the body 213 from the downhole end portion 218 of the body 213. The lead mill 207 may be internally threaded and may attach to the body 213 via the third threads 226 (see FIG. 2-2) of the body 213. An uphole end portion of the second spacer 217 may abut the downhole end portions 247 of the blades 216, and an uphole end portion of the lead mill 207 may abut the downhole end portion of the second spacer 217. At this point, the milling tool 100 may be fully assembled.

Optionally, the lead mill 207 may be a mill head. The lead mill 207 may include internal threads 227 (see FIG. 2-2) configured to couple to the third threads 226 (see FIG. 2-2). The lead mill 207 may also have a plurality of cutting structures 253 along its outer diameter. The cutting structures 253 may include fixed blades, expandable blades, cutting inserts, cutting elements, hardfacing, or other components, and may be composed of metal carbides (e.g., tungsten carbide), natural diamond, polycrystalline diamond compact ("PDC"), cubic-boron-nitride, other materials, or combinations of the foregoing. In some embodiments, the cutting structures 253 may be set in phase with the cutting structures 244 of the blades 216. When set in phase, junk slots between the cutting structures 253 may be aligned with junk slots between the cutting structures 244. In such an embodiment, an axial length of the second spacer 217 may optionally be adjusted in order to move the lead mill 207 to an axial position at which the cutting structures 253 and the cutting structures 244 may be in phase. As will be appreciated by one having ordinary skill in the art in view of the disclosure herein, in some embodiments, the first spacer 215 and/or second spacer 217 may also be eliminated or otherwise removed.

While the lead mill 207 may be a mill having cutting structures, the lead mill 207 may have any number of suitable configurations. For instance, the lead mil 207 may be a mill head, a taper mill, a window mill, a cap, a bull nose, or any other suitable component. In some embodiments, an outer diameter of the lead mill 207 may be less than or about equal to the minimum diameter of the blades 216. In another embodiment, an axial position of the lead mill 207 may be determined by the selected indicator opening 225 of the locking collar 214. In some embodiments, the lead mill 207 may act as a locking head and/or may apply a make-up torque to the components of the mill 205, constraining the blades 216 to the locking collar 214 and the first spacer 215.

Figure 8:
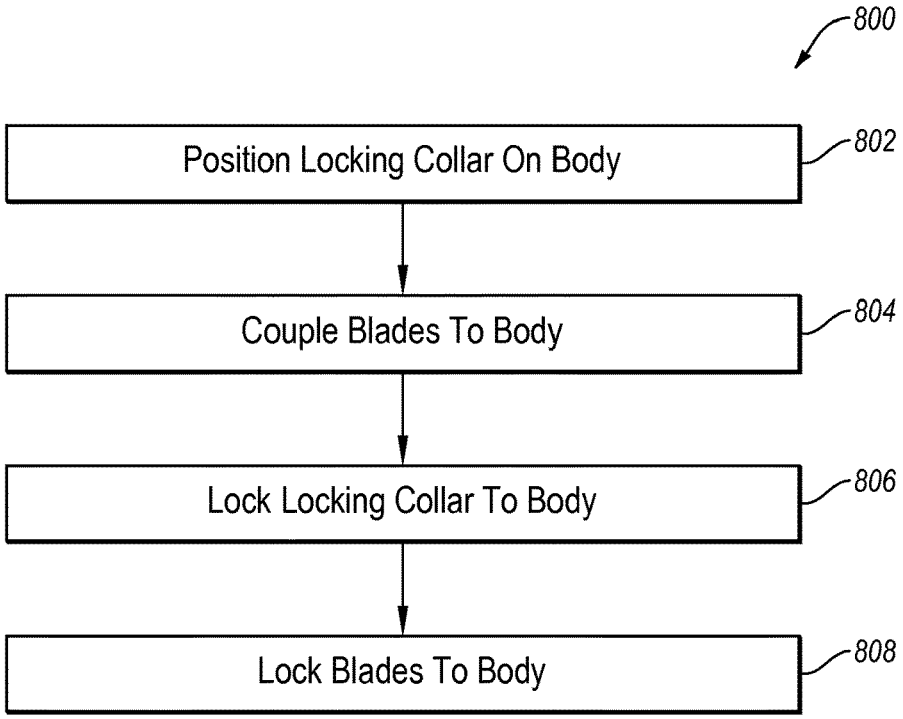
FIG. 8 is a flow diagram of a method for assembling a milling tool, according to some embodiments of the present disclosure.

FIG. 8 is a flow diagram of a method 800 for assembling a mill (e.g., mill 205 of FIG. 2-1) in accordance with aspects of various embodiments described herein. It should be understood that while the method 800 indicates a particular order of execution of operations, in some embodiments, certain portions of the operations might be executed in a different order. Further, in some embodiments, additional operations may be added to the method 800. Likewise, some operations may be omitted.

At 802, a locking collar (e.g., locking collar 214 of FIG. 2-1) may be positioned on a body (e.g., body 213 of FIG. 2-1) of the mill. In some embodiments, the locking collar may initially be positioned as far uphole as possible on the body. In some embodiments, positioning the locking collar at 802 may include sliding the locking collar over a downhole end portion of the body and/or rotating the locking collar. For instance, the locking collar may include threads that mate with threads of the body. Positioning the locking collar at 802 may include using the threads to position the locking collar (e.g., on the threads of the body, to move the locking collar past the threads on the body, etc.).

At 804, one or more blades (e.g., blades 216 of FIG. 2-1) may be coupled to the body. In some embodiments, coupling the blades to the body at 804 may include coupling the blades to one or more tracks (e.g., tracks 230 of FIG. 2-2) of the body. In some embodiments, the blades may be coupled to the tracks by placing the blades on an open ramp portion of the tracks, and moving the blades downhole along toward and/or on a closed ramp portion. Coupling the blades to the body at 803 may include moving the blades until sufficient space is provided uphole on the body to allow the locking collar to move to a locking position. For instance, the blades may be moved to allow an indicator opening 225 (e.g., indicator opening 225 of FIG. 2-2) on the locking collar to align with a threaded opening (e.g., threaded opening 223 of FIG. 2-2) of the body.

At 806, the locking collar may be locked to the body. In some embodiments, the locking collar may be locked rotationally and/or axially to the body. For instance, an indicator screw (e.g., indicator screw 224 of FIG. 2-2) may be coupled to an indicator opening in the locking collar and to a threaded opening in the body. In some embodiments, a pin, clamp, or other mechanism may be used to lock the locking collar to the body at 806.

Optionally, locking the locking collar to the body at 806 may include locking the locking collar at a particular locking position. In some embodiments, multiple locking positions may be available. For instance, there may be multiple indicator openings on the locking collar and/or multiple threaded openings on the body. By aligning particular indicator openings with a particular threaded openings, different locking positions may be obtained. Each locking position may correspond to a particular outer diameter of the blades.

At 808, the blades may be locked to the body. In some embodiments, locking the blades to the body at 808 may include moving the blades so that they are constrained by the locking collar. For instance, the blades may be moved uphole toward or even adjacent a locking collar that is locked at a locking position. A locking head (e.g., lead mill 207 of FIG. 2-1) may be coupled to the body at the downhole end of the blades, and used to constrain the blades. In some embodiments, the locking head may be coupled to the body and positioned adjacent a downhole end portion of the blades. The blades may then be locked to the body and restricted, or even prevented, from moving axially uphole by the locking collar, and axially downhole by the locking head. In some embodiments, the blades may also be restricted, or even prevented, from moving radially. For instance, a fastener (e.g., fastener 238 of FIG. 4-2) may limit radial movement of a blade.

While the blades may be locked to the body by directly using the locking collar and/or a locking head, such embodiments are merely illustrative. For instance, an uphole end portion of the blades may be constrained by a spacer (e.g., first spacer 215 of FIG. 2-1) and/or a downhole end portion of the blades may be constrained by a spacer (e.g., second spacer 217 of FIG. 2-1). For instance, a first spacer (or collar spacer) may be positioned between the locking collar and the blades so that the locking collar indirectly constrains or locks the blades at an axial and/or radial position. In the same or other embodiments, a second spacer (or a head spacer) may be positioned between the blades and the locking head so that the locking head indirectly constrains or locks the blades at an axial and/or radial position. In particular, the locking head may constrain the blades against one or more of a locking collar, a collar spacer, or a head spacer.

Further, the outer diameter of the blades may be determined based on the axial position of the blades. The axial position of the blades may be based on the selected indicator opening (and the locking position) in some embodiments. The radial position of the blades, and the gauge diameter of the mill, may also be influenced by the axial position of the blades. Additional features that may influence the axial position of the blades and/or the radial position of the blades may include the size (e.g., length) of one or more spacers, the length of a locking head and/or locking collar, the radial height of the blades, the length of a track on the body, the slope of the track on the body, the diameter of the body, and the like.

As will be appreciated by a person having ordinary skill in the art in view of the present disclosure, disassembly of the mill may be performed by reversing one or more of the elements of the method 800 in FIG. 8. For instance, the blades may be unlocked and removed from the body. This may occur by, for instance, removing and/or loosening a locking head, head spacer, or the like. In some embodiments, the locking collar may be unlocked from the body. This may occur by, for instance, removing an indicator screw and allowing the locking collar to rotate and/or move axially along the body of the mill. With the locking collar unlocked and moved, the blades may move along one or more tracks, in some embodiments, to an open ramp portion. The open ramp portion may allow the blades to be removed from the body. The locking collar and/or one or more spacers may also be removed by moving them axially along the body.

Figure 9:
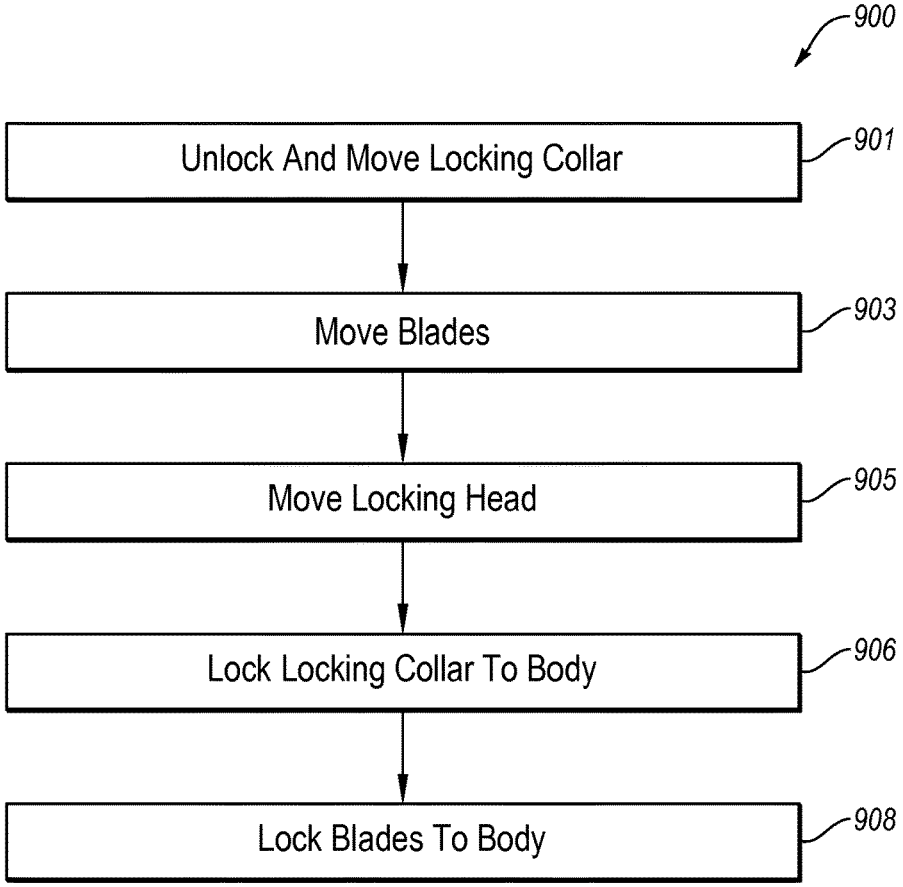
FIG. 9 is a flow diagram of a method for adjusting a gauge diameter of a milling tool, according to some embodiments of the present disclosure.

FIG. 9 is a flow diagram of a method 900 for adjusting a gauge diameter of a mill (e.g., mill 205 of FIG. 2-1) in accordance with aspects of various embodiments described herein. It should be understood that while the method 900 indicates a particular order of execution of operations, in some embodiments, certain portions of the operations might be executed in a different order. Further, in some embodiments, additional operations may be added to the method 900. Likewise, some operations may be omitted. It should also be appreciated that the method 800 of FIG. 8 may also be an example of a method for adjusting a gauge diameter of a mill, in that assembling the mill may establish a gauge diameter for the mill.

For the method 900, the mill may have been previously assembled to have a particular gauge diameter, and the method 900 may allow the mill to be adjusted to have a second gauge diameter that may be larger or smaller than the initial gauge diameter. At 901, the locking collar (e.g., locking collar 214 of FIG. 2-1) may be unlocked and moved to obtain the adjusted, or second gauge diameter. For instance, an indicator screw or other mechanism used to lock the locking collar at a locking position may be loosened or removed at 901. This may allow the locking collar to rotate and/or move axially to a different location. In some embodiments, the locking collar may be moved in an uphole direction. In other embodiments, the locking collar may be moved in a downhole direction.

At 903, one or more blades of a mill may be moved. In some embodiments, moving the locking collar at 901 may allow the blades to move. The blades may be moved axially between different portions on a track, which may correspond to different gauge diameters of the mill and the blades. Optionally, the blades may be moved and removed from the body, and then re-coupled to the body and moved. In some embodiments, moving the blades at 903 may include removing the blades and re-coupling different blades to the body. Moreover, as each blade may be different, a single blade (or less than a full set of blades) may be removed and re-coupled to the body. Such may be done where, for instance, some blades are damaged.

The locking head (e.g., lead mill 207 of FIG. 2-1) may also be moved at 905. The locking head may be moved to move the locking head into contact with the blades that moved at 903, or to allow space for the blades to move (e.g., where moving the locking head at 905 is performed fully or partially before moving the blades at 903). In some embodiments, moving the locking head at 905 may include threading the locking head further onto the body, or fully or partially unthreading the locking head on the body. In some embodiments, moving the locking head at 905 may include removing the locking head from the body.

At 906, the locking collar may be locked to the body. In some embodiments, the locking collar may be locked rotationally and/or axially to the body. For instance, an indicator screw (e.g., indicator screw 224 of FIG. 2-2) may be coupled to an indicator opening in the locking collar and to a threaded opening in the body. In some embodiments, a pin, clamp, or other mechanism may be used to lock the locking collar to the body at 906.

Optionally, locking the locking collar to the body at 906 may include locking the locking collar at a particular locking position. In some embodiments, multiple locking positions may be available. For instance, there may be multiple indicator openings on the locking collar and/or multiple threaded openings on the body. By aligning particular indicator openings with a particular threaded openings, different locking positions may be obtained. Each locking position may correspond to a particular outer diameter of the blades. In some embodiments, locking the collar to the body 906 may be performed before or after moving the blades at 903 and/or moving the locking head at 905.

At 908, the blades may be locked to the body. In some embodiments, locking the blades to the body at 908 may include moving the blades so that they are constrained by the locking collar. For instance, the blades may be moved uphole toward or even adjacent a locking collar that is locked at a locking position. A locking head (e.g., lead mill 207 of FIG. 2-1) may be coupled to the body at the downhole end of the blades, and movement or locking of the locking head and/or of the locking collar may constrain the blades. In some embodiments, the blades may be locked to the body and restricted, or even prevented, from moving axially uphole by the locking collar, and axially downhole by the locking head. In some embodiments, the blades may also be restricted, or even prevented, from moving radially. For instance, a fastener (e.g., fastener 238 of FIG. 4-2) may limit radial movement of a blade.

The elements of the method 900 are illustrative and additional or other elements may be included. For instance, the locking collar, blades, locking head, one or more spacers, etc. may be locked in place. In some embodiments, elements of the method may be performed in various orders. For instance, by moving the locking collar in an uphole direction, the blades, one or more spacers, locking head, and the like may also be able to move in an uphole direction. In some embodiments, the locking collar may be moved first to allow uphole movement of the blades, which may correspond to increasing a gauge diameter of the blades. If the blades are to move downhole (e.g., to reduce the gauge diameter in some embodiments), the locking head may be moved at 905 prior to moving the blades at 903 or optionally before moving the locking collar at 901. Additional elements of the method 900 may also include moving one or more spacers, adding or replacing spacers, changing blades, or the like.

A mill of various embodiments of the present disclosure may be used to perform any of a variety of milling operations. In some embodiments, the mill may be rotated to cause one or more blades of the mill to engage and mill or otherwise grind up various materials (e.g., scale, cement, casing, formation, tools, etc.). As discussed herein, the blades of the mill may be held axially in place by one or more components (e.g., locking collar 214 and lead mill 207 of FIG. 2-1). A track (e.g., track 230 of FIG. 2-2) may guide movement of the blades and/or be used to lock the blades in a particular radial position. As the blades rotate and engage and grind the material, various forces may be applied to the blades. Some of the forces may be rotational forces, and the track and fasteners of the body and the blades may carry the loads induced by those forces to resist, and potentially prevent, the blades from rotating. In some embodiments, the track (e.g., rails, ramps, fasteners, etc.) may be the primary structure for resisting the rotational forces. In other embodiments, however, one or more other components may be provided to counteract the rotational forces and resist such rotation.

Figure 10:
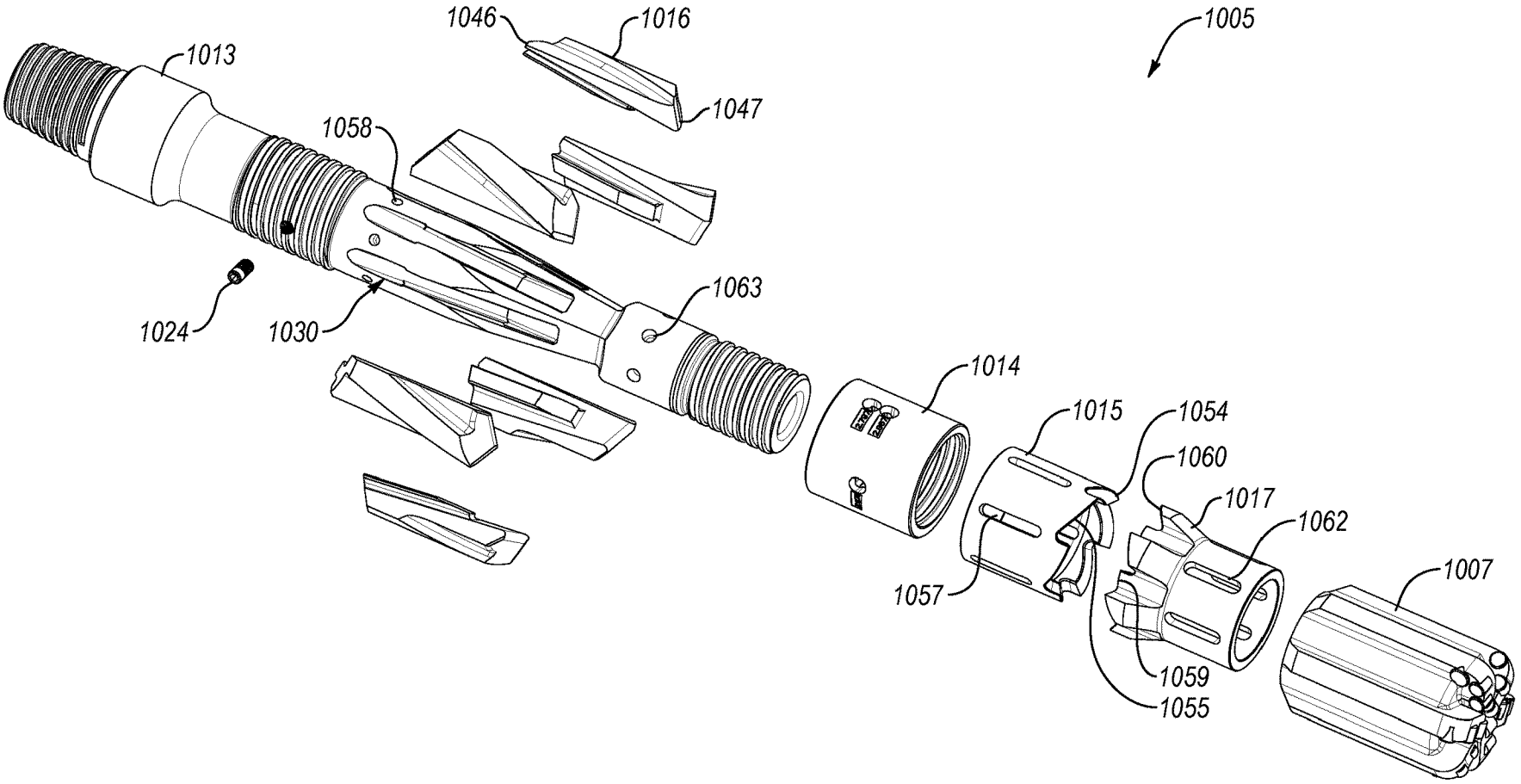
FIG. 10 is an exploded, assembly view of a milling tool, according to another embodiment of the present disclosure.

FIG. 10, for instance, is an exploded, assembly view of an example mill 1005 which may use one or more spacers to counteract the rotational, reaction forces placed on various blades 1016. In this embodiment, the mill 1005 may have various components similar to corresponding components of the mill 205 of FIGS. 2-1 and 2-2. For instance, the locking collar 1014 and lead mill 1007 may generally be structurally and/or operationally similar to the locking collar 214 and lead mill 207, respectively of FIGS. 2-1 and 2-2. In some embodiments, however, one or more of the body 1013, first spacer 1015, blades 1016, or second spacer 1017 may be modified to allow additional components to distribute some of the load carried by the blades 216 and/or tracks 230 of the mill 205.

In this particular embodiment, for instance, the blades 1016 may have uphole end portions 1046 having angled, curved, or otherwise contoured surfaces. The first spacer 1015 may have a similarly contoured downhole end portion 1054. In particular, in this embodiment, each blade 1016 may have a similarly contoured uphole end portion 1046. The downhole end portion 1054 of the first spacer 1015 may therefore define various teeth 1055 which mate with the blades 1016. The uphole end portions 1046 of the blades 1016 may collectively define teeth mating with the teeth 1055. The teeth 1055 (and thus the uphole end portions 1046 of the blades 1016) may have any suitable shape, and may be jagged, saw-toothed, notched, serrated, undulating, or the like.

In operation, as the mill 1005 rotates, the blades 1016 may engage the material being milled, which generate reactionary forces on the blades 1016. In addition to, or instead of, these reactionary forces being transmitted to the tracks 1030 of the body 1013, the blades 1016 may engage the teeth 1055 of the first spacer 1015, so that some of the forces can be at least partially distributed to the first spacer 1015. In some embodiments, these forces may push against the teeth 1055 and cause the first spacer 1015 to rotate. To restrict or even prevent the first spacer 1015 from rotating, a retention mechanism 1056 (see FIG. 11-1) may be used. The retention mechanism 1056 may include a pin, screw (e.g., set screw), clamp, clasp, other component, or some combination of the foregoing, and may be used to restrict rotational movement of the first spacer 1015. In this embodiment, for instance, the first spacer 1015 may include a slot 1057 or other opening therein. The slot 1057 may be rotationally aligned with an opening 1058 in the body 1013. The retention mechanism 1056 may be positioned in the slot 1057 and the opening 1058 to restrict relative rotational movement between the first spacer 1015 and the body 1013. In some embodiments, one or more of the slot 1057 or the opening 1058 may be omitted. In the same or other embodiments, the locking mechanism may include a spring-loaded pin in the body 1013 or the first spacer 1015.

In some embodiments, the blades 1016 may have downhole end portions 1047 having angled, curved, or otherwise contoured surfaces. The second spacer 1017 may have a similarly contoured uphole end portion 1059. In particular, in this embodiment, each blade 1016 may have a similarly contoured downhole end portion 1047. The uphole end portion 1059 of the second spacer 1017 may therefore define various teeth 1060 which mate with the blades 1016. The downhole end portions 1047 of the blades 1016 may collectively define teeth mating with the teeth 1060. The teeth 1060 (and thus the downhole end portions 1047 of the blades 1016) may have any suitable shape, and may be jagged, saw-toothed, notched, serrated, undulating, or the like.

In operation, as the mill 1005 rotates, the blades 1016 may push against the teeth 1060 of the second spacer 1017, similar to how the blades 1016 push against the teeth 1055 of the first spacer 1015. The second spacer 1017 may therefore carry some of the reactionary forces to reduce the load carried by the tracks 1030. To restrict or even prevent the second spacer 1017 from rotating, a retention mechanism 1061 (see FIG. 11-1) may be used. The retention mechanism 1061 may include a pin, screw (e.g., set screw), clamp, clasp, other component, or some combination of the foregoing, and may be used to restrict rotational movement of the second spacer 1017. In this embodiment, for instance, the second spacer 1017 may include a slot 1062 or other opening therein. The slot 1062 may be rotationally aligned with an opening 1063 in the body 1013. The retention mechanism 1061 may be positioned in the slot 1062 and the opening 1063 to restrict relative rotational movement between the second spacer 1017 and the body 1013. In some embodiments, one or more of the slot 1062 or the opening 1063 may be omitted. In the same or other embodiments, the locking mechanism may include a spring-loaded pin in the body 1013 or the first spacer 1015.

Figures 1, 11:
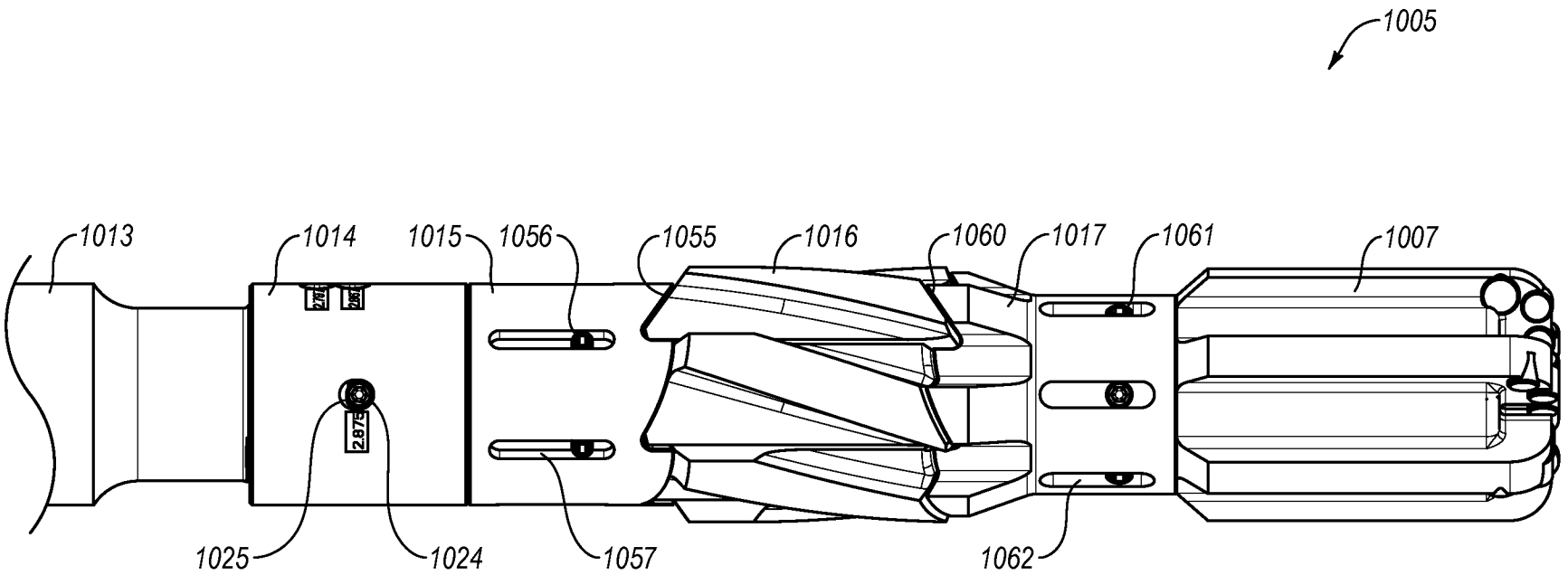
Figures 2, 11:
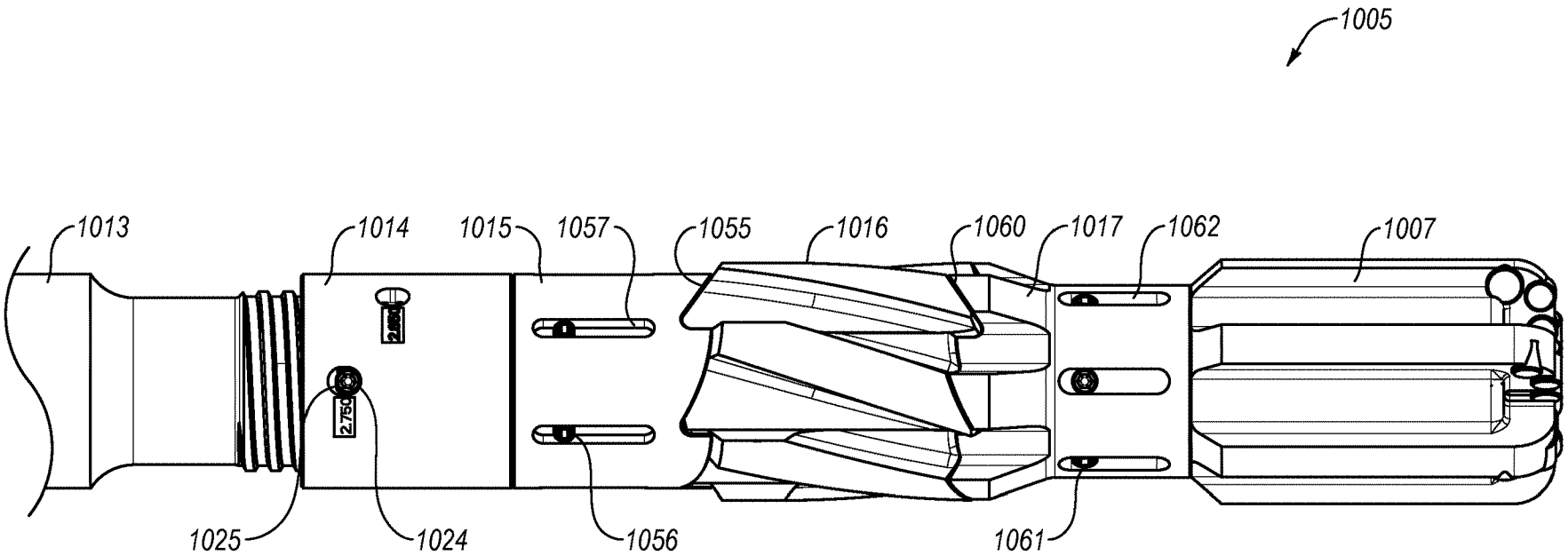

FIGS. 11-1 and 11-2 illustrate an example embodiment of the mill 1005 of FIG. 10 in an assembled form. In particular FIG. 11-1 illustrates the mill 1005 in a first position in which the blades 1016 are at an expanded position, while FIG. 11-2 illustrates the mill 1005 in a second position in which the blades 1016 are in a retracted position.

Similar to other embodiments disclosed herein, the blades 1016 may be expanded radially by, for instance, moving axially along a track 1030 (see FIG. 10) that is sloped. In FIG. 11-1, for instance, the blades 1016 may be located at a more axially uphole position in which the track may be further from the longitudinal axis of the mill 1005 as compared to the more axially downhole position illustrated in FIG. 11-2. In each position, a locking collar 1014 may be locked at a particular locking position. For instance, an indicator screw 1024 or other locking mechanism may be used with different indicator openings 1025 to position the locking collar 1014 in a more uphole (FIG. 11-1) or more downhole (FIG. 11-2) locking position. The blades 1016 may then be locked to the body 1013 and restricted, or even prevented, from moving axially, rotationally, or radially. For instance, the first and second spacers 1015, 1017, and locking head 1007 may restrict the axial movement of the blades 1016. The tracks 1030 (see FIG. 10), fasteners, rails, or other components may restrict radial and/or rotational movement of the blades 1016 relative to the body 1013.

As also shown in FIGS. 11-1 and 11-2, when the locking collar 1014 is at different axial positions and the blades 1016 are at different axial and radial positions, the first and second spacers 1015, 1017 may similarly be at different axial positions. In this embodiment, the slots 1057, 1062 are shown as being elongated. This may allow, for instance, the retention mechanisms 1056, 1061 to remain in the slots 1057, 1062 while the first and second spacers 1015, 1017 are moved between axial positions. In other embodiments, however, multiple discrete openings may be used in lieu of, or in addition to, elongated slots.

While FIGS. 10 to 11-2 illustrate the teeth 1055, 1060 on the first and second spacers 1015, 1017, respectively, the teeth 1055, 1060 or other features may be eliminated or located on other components. For instance, the first spacer 1015 and/or second spacer 1017 may be eliminated. In such an embodiment, the teeth 1055, 1060 may potentially be formed directly on one or more of the locking collar 1014 or the lead mill 1007.

It should be appreciated in view of the disclosure herein, that blades and cutting structures described herein may be coupled and even locked to an outer surface of a mill, stabilizer, or other tool. During use, the blades and cutting structures may become worn or damage. In some embodiments, wear and damage may occur to some blades and cutting structures and not others, or more occur more rapidly to some blades and cutting structures than to others. Using individual blades as described herein, individual blades may be replaced rather than replacing an entire milling tool as may be done for a tool with blades permanently fixed to an outside surface of the milling tool, or to each other.

In addition, certain oilfield operations may call for mills having blades and cutting structures of varying diameters. Consequently, an inventory of milling tools may be maintained during oilfield operations, where respective milling tools may have cutting structures of a different diameter than the other milling tools. In some embodiments, blades may be formed of different sizes so that different minimum and maximum diameters may be achieved using the same components of a mill. As a result, one or more of the same body, locking collar, lead mill or other locking head, or spacers may be used with a variety of different sizes of blades, spacers, or the like.

In sum, various embodiments described above with respect to FIGS. 1-11-2 may allow for a mill with blades adjustable to have different gauge diameters. To alter the gauge diameter of the blades used in an oilfield or other operation, the positioning of a locking collar may be changed, as opposed to replacing the mill with another tool or even with different blade sizes (although different blade sizes may also be used in some embodiments). Moreover, a damaged blade may be removed from the mill through full or partial disassembly, as compared with discarding an entire mill or full set of blades.

In the description herein, various relational terms may be provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation and/or illustrated position relative to one or more other components. Relational terms do not indicate a particular orientation or location for each embodiment within the scope of the description or claims. For example, a component of a milling tool that is described as "downhole" of another component may be further from the surface while within a vertical wellbore, but may have a different orientation during assembly, when removed from the wellbore, or in a lateral or other deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

While the description or claims may refer to "an additional" or "other" element, feature, aspect, component, or the like, it does not preclude there being a single element, or more than one, of the additional or other element. Where the claims or description refer to "a," "an," or "the" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or machined from the same one or more pieces of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in any combination. Features and aspects of methods described herein may be performed in any order.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

Downhole tools, milling tools, mills, milling systems, expandable tools, stabilizers, blades, and other components discussed herein or which would be appreciated in view of the disclosure herein may be used in other applications and environments. In other embodiments, for instance, milling tools, methods of milling, methods of assembling a mill, methods of adjusting a mill, downhole tools, adjustable tools, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide lower and upper limits. It should be appreciated that ranges including the combination of any two values are contemplated unless otherwise indicated, that a particular value may be selected, or an upper or lower limit may be identified using a particular value. Numbers, percentages, ratios, measurements, or other values stated herein are intended to include the stated value as well as other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 10%, within 5%, within 1%, within 0.1%, or within 0.01% of a stated value. Furthermore, the term "substantially" as used herein represents an amount close to the stated amount that still performs a desired function or achieves a desired result. For example, the term "substantially" may refer to an amount that is within 5% of, within 1% of, within 0.1% of, and within 0.01% of a stated amount or value.

The terms "comprising," "including," and "having" are intended to be inclusive and mean that there may be additional elements other than the listed elements. It should be understood that references to "one embodiment" or "an embodiment" of the present disclosure are not intended to be interpreted as excluding the existence of additional embodiments that also incorporate the recited features. Unless otherwise stated, amounts listed in percentages are weight percent.

The Abstract included with this disclosure is provided to allow the reader to quickly ascertain the general nature of some embodiments of the present disclosure. The Abstract is submitted with the understanding that it will not be used to interpret or limit the scope or meaning of the claims.

What is claimed is:

1. A mill, comprising:

a body having a plurality of sloped tracks axially along the body;

a locking collar coupled to the body, the locking collar being axially movable along an outer surface of the body between a plurality of locking positions, the locking collar having a threaded connection to the body;

a plurality of blades coupled to the plurality of sloped tracks and located axially downhole relative to the locking collar, a gauge diameter of the plurality of blades being variable based on axial positions of the plurality blades on the plurality of sloped tracks, and the axial positions of the plurality of blades corresponding to the plurality of locking positions of the locking collar, the plurality of blades collectively defining a plurality of teeth configured to distribute forces away from the plurality of sloped tracks; and a locking head coupled to the body, the plurality of blades being located axially uphole relative to the locking head and axially fixed between the locking collar and the locking head, the plurality of teeth configured to rotationally engage the locking collar, the locking head, or the locking collar and the locking head.

2. The mill of claim 1, the plurality of sloped tracks including a plurality of ramps, an outer diameter of the plurality of ramps decreasing in a downhole axial direction.

3. The mill of claim 1, the plurality of sloped tracks each including a ramp and at least one rail.

4. The mill of claim 1, the plurality of sloped tracks defining a plurality of channels configured to restrict rotational and radial movement of the plurality of blades.

5. The mill of claim 1, further comprising:

a screw locking the locking collar to the body at a selected locking position.

6. The mill of claim 1, the plurality of teeth configured to distribute reaction forces to at least one of the locking collar or a spacer axially between the locking collar and the plurality of blades.

7. The mill of claim 1, the plurality of locking positions corresponding to a plurality of indicator openings within the locking collar, the plurality of indicator openings being configured to facilitate locking of the locking collar rotationally and axially to the body, wherein locking of the locking collar fixes the plurality of blades at a particular gauge diameter.

* * * * *